US009332792B2

(12) United States Patent
Harber

(10) Patent No.: US 9,332,792 B2
(45) Date of Patent: May 10, 2016

(54) ARTICLES OF APPAREL UTILIZING TARGETED VENTING OR HEAT RETENTION ZONES THAT MAY BE DEFINED BASED ON THERMAL PROFILES

(75) Inventor: Edward Louis Harber, London (GB)

(73) Assignee: NIKE, Inc., Beaverton, OR (US)

( * ) Notice: Subject to any disclaimer, the term of this patent is extended or adjusted under 35 U.S.C. 154(b) by 2470 days.

(21) Appl. No.: 11/059,357

(22) Filed: Feb. 17, 2005

(65) Prior Publication Data

US 2006/0179539 A1 Aug. 17, 2006

(51) Int. Cl.
*A41D 13/002* (2006.01)
*A41D 27/28* (2006.01)

(52) U.S. Cl.
CPC ..... *A41D 13/002* (2013.01); *A41D 27/28* (2013.01); *A41D 2400/10* (2013.01)

(58) Field of Classification Search
CPC ..... A41D 13/002; A41D 27/28
USPC ..... 2/69, 115, 93, 458, DIG. 1, 181.6, 2/209.5, 209.7, 67, 82; 428/913
See application file for complete search history.

(56) References Cited

U.S. PATENT DOCUMENTS

| | | | | | |
|---|---|---|---|---|---|
| 24,968 | A | * | 8/1859 | Warbuton | 264/156 |
| 179,661 | A | | 7/1876 | Lee | |
| 308,244 | A | | 11/1884 | Fishel | |
| 403,934 | A | * | 5/1889 | Fritsch | 2/209.7 |
| 456,785 | A | * | 7/1891 | Webb | 2/181.6 |
| 488,989 | A | * | 1/1893 | Davies | 2/171.8 |
| 601,489 | A | | 3/1898 | Tim | |
| 960,251 | A | * | 6/1910 | Beenken | 2/181.6 |
| 1,093,162 | A | * | 4/1914 | Yokoseki | 2/182.3 |
| 1,118,792 | A | | 11/1914 | Nicholas | |
| 1,234,589 | A | * | 7/1917 | Wells | 2/181.6 |
| 1,252,187 | A | | 1/1918 | Shane | |
| 1,350,169 | A | | 8/1920 | Mullane | |

(Continued)

FOREIGN PATENT DOCUMENTS

| | | |
|---|---|---|
| DE | 27 02 407 | 7/1978 |
| EP | 1 329 167 A2 | 7/2003 |

(Continued)

OTHER PUBLICATIONS

Internet printout: http://niketown.nike.com/ Nike Pro Vent Dri-FIT Long Sleeve Top, dated Mar. 22, 2004.

(Continued)

*Primary Examiner* — Alissa L Hoey
(74) *Attorney, Agent, or Firm* — Banner & Witcoff, Ltd.

(57) ABSTRACT

Garments may include targeted vent or heat retention zones including openings or heat insulation areas in the fabric of various different sizes. The locations and sizes of these openings or heat insulation areas, at least in part, may be determined based on a thermal profile of a body from which the garment is designed. For example, openings or heat insulation areas of a larger size may be provided in the garment at locations where the body typically releases a large amount of heat, and openings or heat insulation areas of smaller sizes may be provided at other locations, e.g., where the body releases less heat. Several thermal profiles may be collected and used to develop a collection of opening patterns, e.g., corresponding to specific body characteristics, body types, and/or ultimate end uses for the garment. Custom patterns may be determined and used in garments specially designed for individual users.

25 Claims, 11 Drawing Sheets

(56) References Cited

U.S. PATENT DOCUMENTS

| | | | | |
|---|---|---|---|---|
| 1,704,576 | A * | 3/1929 | Pellegrino | 2/195.7 |
| 1,778,453 | A * | 10/1930 | Hargraves | 2/67 |
| 1,789,188 | A * | 1/1931 | McGuigan | 2/181.6 |
| 1,824,785 | A * | 9/1931 | Muhlfeld | 2/209.7 |
| 1,973,419 | A | 9/1934 | Trageser | |
| 2,033,065 | A * | 3/1936 | Galligan | 2/67 |
| 2,074,568 | A * | 3/1937 | Sloan | 2/182.3 |
| 2,075,945 | A * | 4/1937 | Hurt | 2/67 |
| 2,183,380 | A * | 12/1939 | Hurt | 2/67 |
| 2,391,535 | A | 12/1945 | Zelano | |
| 2,524,620 | A * | 10/1950 | Cadous | 450/41 |
| 2,659,085 | A * | 11/1953 | Ericson | 450/39 |
| 2,715,226 | A | 8/1955 | Weiner | |
| 2,790,176 | A * | 4/1957 | Cunningham | 2/67 |
| 2,879,518 | A * | 3/1959 | Welton | 2/175.5 |
| 2,949,115 | A * | 8/1960 | Phillips | 450/58 |
| 3,014,218 | A * | 12/1961 | Smith | 2/87 |
| 3,045,243 | A | 7/1962 | Lash et al. | |
| 3,077,196 | A * | 2/1963 | Paxton | 450/39 |
| 3,078,699 | A | 2/1963 | Huntley | |
| 3,086,215 | A | 4/1963 | Di Paola | |
| 3,153,793 | A | 10/1964 | Lepore | |
| 3,253,598 | A * | 5/1966 | Spanel | 450/97 |
| 3,296,626 | A | 1/1967 | Ludwikowski | |
| 3,397,407 | A * | 8/1968 | Gallagher | 2/227 |
| 3,417,408 | A * | 12/1968 | Caggiano | 2/239 |
| 3,613,118 | A * | 10/1971 | Lucas | 2/209.7 |
| 3,665,518 | A * | 5/1972 | Leadford | 2/88 |
| 3,675,245 | A * | 7/1972 | Follett | 2/67 |
| 3,710,395 | A | 1/1973 | Spano et al. | |
| 3,761,962 | A | 10/1973 | Myers | |
| 3,801,987 | A | 4/1974 | Thompson, Jr. | |
| 3,882,549 | A * | 5/1975 | Gaburo | 2/244 |
| 3,956,906 | A * | 5/1976 | Cassidy, Sr. | 66/42 R |
| 4,021,941 | A * | 5/1977 | Caggiano | 36/10 |
| 4,071,236 | A * | 1/1978 | Oprean | 482/55 |
| 4,126,903 | A | 11/1978 | Horton | |
| 4,159,010 | A * | 6/1979 | Mitro | 5/89.1 |
| 4,185,327 | A | 1/1980 | Markve | |
| 4,195,364 | A | 4/1980 | Bengtsson et al. | |
| 4,201,009 | A * | 5/1980 | Burridge, Jr. | 446/27 |
| 4,296,499 | A * | 10/1981 | Patterson et al. | 2/239 |
| 4,458,429 | A * | 7/1984 | Schmid | 36/3 A |
| 4,513,451 | A | 4/1985 | Brown | |
| 4,608,715 | A | 9/1986 | Miller et al. | |
| 4,619,004 | A | 10/1986 | Won | |
| 4,722,099 | A | 2/1988 | Kratz | |
| 4,791,685 | A * | 12/1988 | Maibauer | 2/227 |
| 4,804,351 | A | 2/1989 | Raml et al. | |
| 4,809,690 | A * | 3/1989 | Bouyssi et al. | 602/74 |
| 5,033,118 | A | 7/1991 | Lincoln | |
| 5,101,512 | A * | 4/1992 | Weinstein | 2/84 |
| 5,105,478 | A | 4/1992 | Pyc | |
| 5,206,080 | A | 4/1993 | Tashiro et al. | |
| 5,232,769 | A | 8/1993 | Yamato et al. | |
| 5,282,277 | A | 2/1994 | Onozawa | |
| 5,365,677 | A * | 11/1994 | Dalhgren | 36/3 A |
| 5,446,927 | A * | 9/1995 | Weldon | 2/243.1 |
| 5,469,581 | A * | 11/1995 | Uthoff | 2/69 |
| 5,495,622 | A * | 3/1996 | Kaufman | 2/175.1 |
| 5,509,145 | A * | 4/1996 | Stevenson et al. | 2/195.1 |
| 5,704,064 | A | 1/1998 | van der Sleesen | |
| 5,714,107 | A * | 2/1998 | Levy et al. | 264/289.3 |
| 5,727,256 | A | 3/1998 | Rudman | |
| 5,804,021 | A * | 9/1998 | Abuto et al. | 156/252 |
| 5,822,884 | A * | 10/1998 | Roeder | 36/7.1 R |
| 5,873,868 | A * | 2/1999 | Nakahata | 604/383 |
| 5,901,373 | A * | 5/1999 | Dicker | 2/69 |
| 5,919,411 | A * | 7/1999 | Rezai et al. | 264/154 |
| 6,018,819 | A * | 2/2000 | King et al. | 2/69 |
| 6,047,406 | A * | 4/2000 | Dicker et al. | 2/69 |
| 6,248,710 | B1 | 6/2001 | Bijsterbosch et al. | |
| 6,262,331 | B1 * | 7/2001 | Nakahata et al. | 604/383 |
| 6,279,161 | B1 * | 8/2001 | Johnston | 2/69 |
| 6,286,145 | B1 * | 9/2001 | Welchel et al. | 2/69 |
| 6,299,505 | B1 * | 10/2001 | Huang | 450/57 |
| 6,332,221 | B1 | 12/2001 | Gracey | |
| 6,339,845 | B1 | 1/2002 | Burns et al. | |
| 6,430,764 | B1 | 8/2002 | Peters | |
| 6,539,752 | B1 * | 4/2003 | Apollonio | 66/215 |
| 6,550,474 | B1 | 4/2003 | Anderson et al. | |
| 6,640,715 | B1 | 11/2003 | Watson et al. | |
| 6,647,549 | B2 | 11/2003 | McDevitt et al. | |
| 6,662,599 | B1 * | 12/2003 | Apollonio | 66/215 |
| 6,665,883 | B2 * | 12/2003 | Sloan | 2/239 |
| 6,871,515 | B1 * | 3/2005 | Starbuck et al. | 66/169 R |
| 6,993,858 | B2 * | 2/2006 | Seamans | 36/3 A |
| 7,043,766 | B1 * | 5/2006 | Foreman et al. | 2/81 |
| D522,723 | S * | 6/2006 | Fuerst | D2/923 |
| D534,341 | S * | 1/2007 | Choi | D2/971 |
| 7,174,573 | B1 * | 2/2007 | Chen et al. | 2/209.5 |
| 7,214,120 | B2 * | 5/2007 | Kaye et al. | 450/39 |
| 7,219,371 | B2 * | 5/2007 | Liu | 2/7 |
| D567,483 | S * | 4/2008 | Liow | D2/896 |
| D571,547 | S * | 6/2008 | Yang | D2/969 |
| D571,548 | S * | 6/2008 | Seamans | D2/971 |
| D579,637 | S * | 11/2008 | Liow | D2/925 |
| D579,651 | S * | 11/2008 | Hearn | D2/972 |
| D590,588 | S * | 4/2009 | del Biondi et al. | D2/969 |
| 2002/0189608 | A1 | 12/2002 | Raudenbush | |
| 2003/0061650 | A1 * | 4/2003 | Emanuel | 2/115 |
| 2003/0131397 | A1 * | 7/2003 | Sloan | 2/239 |
| 2004/0025217 | A1 * | 2/2004 | Mazzarolo | 2/69 |
| 2004/0231189 | A1 * | 11/2004 | Seamans | 36/3 A |
| 2005/0034204 | A1 * | 2/2005 | Kassai et al. | 2/69 |
| 2005/0086721 | A1 * | 4/2005 | Lambertz | 2/69 |
| 2005/0125872 | A1 * | 6/2005 | Hobbs et al. | 2/67 |
| 2005/0204448 | A1 * | 9/2005 | Wise et al. | 2/69 |
| 2005/0204449 | A1 * | 9/2005 | Baron et al. | 2/69 |
| 2005/0246813 | A1 * | 11/2005 | Davis et al. | 2/69 |
| 2006/0048407 | A1 * | 3/2006 | Seamans | 36/3 R |
| 2006/0200890 | A1 * | 9/2006 | Prat Gonzalez | 2/69 |
| 2006/0277645 | A1 * | 12/2006 | Okajima | 2/69 |
| 2007/0022510 | A1 * | 2/2007 | Chapuis et al. | 2/69 |
| 2007/0050879 | A1 * | 3/2007 | Etzold et al. | 2/69 |
| 2007/0271671 | A1 * | 11/2007 | Okajima | 2/69 |

FOREIGN PATENT DOCUMENTS

| | | |
|---|---|---|
| GB | 963960 | 7/1964 |
| GB | 2 108 822 A | 5/1983 |
| GB | 2 193 429 A | 2/1988 |
| JP | 8-113804 | 7/1996 |
| JP | 2001-49513 | 2/2001 |
| WO | WO 91/09544 | 7/1991 |

OTHER PUBLICATIONS

Internet printout: http://niketown.nike.com/ Nike Pro Vent Dri-FIT Short-Sleeve Top, dated Mar. 22, 2004.

Internet printout: http://niketown.nike.com: Nike Pro Vent Dri-FIT Sleeveless Top, dated Mar. 22, 2004.

Internet printout: http://niketown.nike.com: Dri-FIT One Mesh Tank, dated Mar. 22, 2004.

Internet printout: http://niketown.nike.com: Nike Sphere Switchback Long-Sleeve, dated Mar. 22, 2004.

Internet printout: http://niketown.nike.com: UV Dri-FIT Long-Sleeve Top, dated Mar. 22, 2004.

Internet printout: http://niketown.nike.com: Dri-FIT One Long Short, dated Mar. 22, 2004.

Internet printout: http://niketown.nike.com: Nike Sphere Ultralight Tank, dated Mar. 22, 2004.

Internet printout: http://niketown.nike.com: Nike Sphere Yoked Sleeveless Top, dated Apr. 9. 2004.

Internet printout: http://niketown.nike.com: Nike Sphere Switchback Short-Sleeve, dated Apr. 9, 2004.

Internet printout: http://niketown.nike.com: New Sphere Yoked Short-Sleeve Top, dated Apr. 9, 2004.

Internet printout: http://niketown.nike.com: Nike Sphere Ultralight Top, dated Apr. 9, 2004.

Internet printout: http://niketown.nike.com: Nike Sphere Dry Crew, dated Apr. 9, 2004.

(56) References Cited

OTHER PUBLICATIONS

Internet printout: http://niketown.nike.com: Global Nike Sphere Top, dated Apr. 9, 2004.
Internet printout: http://niketown.nike.com: Global Nike Sphere Polo, dated Apr. 9, 2004.
Internet printout: http://niketown.nike.com: Nike Sphere Switchback Long-Sleeve, dated Apr. 9, 2004.
Internet printout: http://niketown.nike.com: Nike Sphere Warm-Up, dated Apr. 9, 2004.
Internet printout: http://niketown.nike.com: Nike Sphere Ultralight Tank, dated Apr. 9, 2004.
Internet printout: http://realtytimes.com—Agent News and Advice, dated Mar. 24, 2004.
Regenold, "Look cool in hot times with Eco-Mesh", Internet Article, dated Apr. 17, 2004.
Weisey, "Grand Canyon Hike", Internet Article, dated Jun. 26, 2000.
Anonymous, "Loughborough University and adidas join forces to help Olympians beat the heat in Athens", Internet Article, dated Jul. 7, 2004.
Anonymous, "adidas Clima Cool", Internet Article, dated Jul. 12, 2005.
John Buckley Sports—Apparal—Adidas; internet article.

* cited by examiner

ARTICLES OF APPAREL UTILIZING TARGETED VENTING OR HEAT RETENTION ZONES THAT MAY BE DEFINED BASED ON THERMAL PROFILES

FIELD OF THE INVENTION

Aspects of the present invention generally relate to apparel including heat retention or vented zones at targeted locations in the garment structure to provide enhanced or improved heating or cooling effects. The targeted locations may be defined based on thermal profiles.

BACKGROUND

One of the biggest challenges athletes face when competing or training, particularly in moderate to hot temperature conditions, is heat. Not only must the athlete cope with heat from the external environment, but he/she also must cope with heat generated within his/her own body as a result of physical exertion.

Substantial heat may be generated in a person's body as a result of physical activity and exertion. In general, a body's core temperature rises with increased physical activity. Less than 25% of the energy created during physical activity typically is converted into work energy (e.g., energy used to move the body and/or resist an applied force). The remaining 75%+ of the energy typically must be dissipated as released heat. The human body's most effective mechanism for dealing with excess heat is through evaporative cooling. When a person's core body temperature rises to a certain level, the body will start to sweat. When this liquid sweat evaporates, the physical conversion of the liquid to its corresponding gas form (i.e., the drying) draws heat from the nearest heat source. In the case of sweat, the nearest heat source is the skin. In this manner, sweating cools a person due to the evaporative cooling action as the sweat dries.

The evaporation of sweat is dependent, at least to some extent, upon the water vapor pressure (or relative humidity) of the air in contact with the skin. Air movement also is an important factor. For example, ambient air gains humidity as it picks up moisture during the evaporation of sweat. In the absence of adequate air movement (ventilation), this humidified air can become trapped in areas immediately surrounding the skin, thus inhibiting the cooling provided by the continued evaporation of sweat.

Failure to properly release and move heat away from the body during exercise or exertion, particularly in a warm environment, can cause a dangerous rise in a person's body temperature, potentially resulting in adverse health consequences, such as heat exhaustion or heat stroke. To a person reaching his/her limit of heat tolerance, a reduction in core body temperature of even a few tenths of a degree Fahrenheit may make a substantial difference.

Various known garment features are available and used to assist athletes in coping with excess heat generated as a result of physical exertion. For example, mesh venting has been used in garments to help dissipate heat. In sports apparel, it is common to see underarm vents provided by very small or closed-hole meshes or by small eyelets provided through the fabric. While helpful, such meshes or vents typically are too small or too impermeable to provide adequate cooling effects. Additionally, such vents typically are not large enough and/or located at targeted positions so as to provide improved cooling action.

Adequate cooling is not the only body temperature control issue that athletes and others face. The human body also may suffer adverse affects when exposed to cool or cold environmental conditions, particularly when exposed to such conditions for lengthy time periods. While people can simply add another layer of clothing to help stave off the adverse effects of a cold environment in some situations, the addition of clothing layers can adversely impact the wearer's ability to move, particularly when engaged in exercise, athletic events, or other activities requiring movement. The adverse impact on performance and comfort may deter some users from adequately dressing to protect themselves from the cold.

Accordingly, it would be advantageous to provide apparel with targeted heat retention or cooling zones to improve the body's heating or cooling effectiveness, and in many instances, to optimize and/or maximize the heating or cooling effectiveness of the body. Such targeted heat retention or venting, in at least some instances, also may improve an athlete's comfort and/or performance during the physical activity.

SUMMARY

The following presents a general summary of aspects of the invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Some aspects of the present invention relate to garments that include targeted venting zones that assist in efficiently and effectively cooling the wearer. Such garments may include, for example: a first fabric panel; and a pattern of openings defined in the first fabric panel, wherein the pattern is defined based on a thermal profile of a body, wherein the thermal profile distinguishes between areas of the body having different thermal characteristics. In at least some examples of the invention, the thermal profile will define at least a first area of the body having a first thermal characteristic and a second area of the body having a second thermal characteristic, and the pattern of openings will define locations for plural openings of a first size corresponding to the first area and locations for plural openings of a second size corresponding to the second area. If desired, additional openings of additional sizes also may be provided corresponding to other areas of the body, e.g., based on the thermal profile, without departing from the invention.

Additional example aspects of the present invention relate to garments that include: (a) a garment structure for at least a portion of an upper torso, wherein the garment structure includes at least a first fabric panel; and (b) a pattern of openings defined in the garment structure. The pattern of openings may include, for example: (i) plural openings of a first size or larger provided in a portion of the garment structure corresponding to at least a portion of a wearer's spine, and (ii) plural openings smaller than the first size provided in a portion of the garment structure corresponding to a first area of the wearer's back laterally located on a first side of the wearer's back from the wearer's spine. Optionally, in at least some examples, additional plural openings of the first size or larger may be provided in a portion of the garment structure corresponding to a second area of the wearer's back laterally located from the wearer's spine and proximate to the wearer's neck. If desired, the patterns of openings (e.g., like those described above) may be designed so that various sets of openings are provided on each side of the wearer's spine.

Additional aspects of the invention relate to methods for developing opening patterns and/or collections of opening patterns for use in producing garments with zoned venting. Such methods may include, for example: (a) determining a thermal profile of a body, wherein the thermal profile defines at least a first area of the body having a first thermal characteristic and a second area of the body having a second thermal characteristic; and (b) developing or defining an opening pattern based on the thermal profile, wherein the opening pattern defines locations for plural openings of a first size in a garment structure at locations corresponding to the first area and locations for plural openings of a second size in the garment structure at locations corresponding to the second area. Optionally, additional openings of still other sizes also may be defined in the pattern, e.g., based on areas of the body having still different thermal characteristics. Of course, all of the openings may be made in any desired shape, including in a variety of different shapes, without departing from the invention.

This invention also relates to garments that include targeted zones to help insulate or retain heat with the wearer's body (e.g., for use in cool or cold conditions). Such garments may include, for example: a first fabric panel, and a pattern of plural discrete areas of increased insulation or heat retention capability defined in or on the first fabric panel. This pattern may be defined based on a thermal profile of a body, as described above. The pattern of areas of increased insulation or heat retention capability may define locations for at least first and second areas of increased insulation or heat retention capability in a garment structure corresponding to first and second areas of the thermal profile with different thermal characteristics, respectively.

Methods for forming garments having targeted areas of increased insulation or heat retention capability according to aspects of this invention may include, for example: (a) determining a thermal profile of a body, wherein the thermal profile distinguishes between areas of the body having different thermal characteristics, and wherein the thermal profile defines at least first and second areas of the body having first and second thermal characteristics, respectively; (b) forming fabric into a garment structure; and (c) producing plural discrete areas of increased insulation or heat retention capability in the fabric based on the thermal profile, wherein at least a first discrete area of increased insulation or heat retention capability is produced in a first portion of the fabric at a location corresponding to the first area, and wherein at least a second discrete area of increased insulation or heat retention capability is produced in a second portion of the fabric at a location corresponding to the second area.

Still other aspects of the invention relate to methods for providing patterns of areas of increased insulation or heat retention capabilities for use in garment structures. Such methods may include, for example: (a) determining a thermal profile of a body, wherein the thermal profile distinguishes between areas of the body having different thermal characteristics, and wherein the thermal profile defines at least first and second areas of the body having first and second thermal characteristics, respectively; and (b) developing a pattern of plural discrete areas of increased insulation or heat retention capability based on the thermal profile, wherein the pattern defines locations for at least first and second discrete areas of increased insulation or heat retention capability in a garment structure corresponding to the first and second areas of the body, respectively.

In other example aspects of this invention, a variety of thermal profiles may be collected and/or used to develop a collection and/or catalogue of opening patterns or patterns of increased insulation or heat retention capability, e.g., for different individuals; for different body types or physical characteristics; for different exercises, athletic events, activities, and/or other end uses; etc. Collections of patterns of this type may be used by individuals, manufacturers, retailers, or others to help customize opening patterns or patterns of increased insulation or heat retention capability to be provided in specific garments.

At least some example methods according to the invention further may include forming garment structures from fabrics that include or are later modified to include plural openings, insulation zones, or heat retention zones defined therein or thereon, wherein the locations and sizes of the openings or zones are determined based on patterns like those described above.

BRIEF DESCRIPTION OF THE DRAWINGS

The above and other objects, features, and advantages of the present invention will be more readily apparent and more fully understood from the following detailed description, taken in conjunction with the appended drawings, in which.

DETAILED DESCRIPTION

Figure 1:
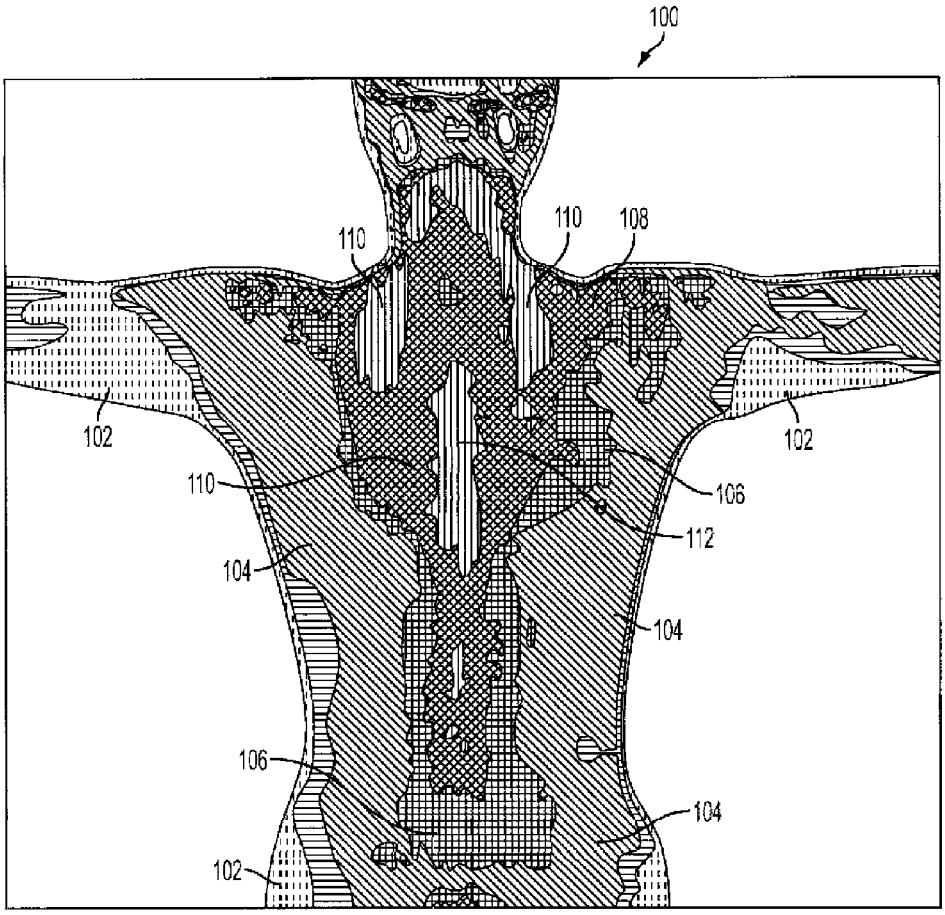
FIG. 1 illustrates an example of a thermal profile (e.g., an infrared based image) of an individual that may be used in defining vent opening patterns in accordance with aspects of this invention.

Various specific examples of the invention are described in detail below in conjunction with the attached drawings.

A. GENERAL DESCRIPTION OF ASPECTS OF THE INVENTION

In general, aspects of this invention relate to garments having targeted vent zones or zones of increased insulation or heat retention capability at specific locations of the garment structure to improve cooling or heat retention efficiency and effectiveness and thereby, in at least some instances, increase the wearer's comfort level and/or improve his or her performance.

Garments in accordance with at least some examples of this invention may include: (a) a garment structure for at least a portion of an upper torso, wherein the garment structure includes at least a first fabric panel; and (b) a pattern of openings defined in the garment structure. The pattern of openings, in at least some example garments according to this invention, may include: (i) plural openings of a first size or larger provided in a portion of the garment structure corresponding to at least a portion of a wearer's spine, and (ii) plural openings smaller than the first size provided in a portion of the garment structure corresponding to a first area of the wearer's back laterally located on a first side of the wearer's back from the wearer's spine. Optionally, the pattern of openings provided in at least some example garment structures in accordance with this invention further may include one or more of the following: (iii) plural openings smaller than the first size provided in a portion of the garment structure corresponding to a second area of the wearer's back laterally located on a second side of the wearer's back from the wearer's spine; (iv) plural openings of the first size or larger provided in a portion of the garment structure corresponding to a third area of the wearer's back laterally located on the first side of the wearer's back from the wearer's spine and proximate to the wearer's neck, and/or (v) plural openings of the first size or larger provided in a portion of the garment structure corresponding to a fourth area of the wearer's back laterally located on the second side of the wearer's back from the wearer's spine and proximate to the wearer's neck.

Garments for use in cool or cold conditions may be provided by replacing the vent openings of the various sizes, shapes, and locations described above with additional insulating material or material with increase heat retaining capacity.

Of course, the sizes and shapes of the various openings may vary in a given portion of the garment structure without departing from the invention. For example, portions of the garment structure having openings smaller than the first size, may include openings of a second size or smaller, openings of a third size or smaller, etc., wherein the openings of the third size are smaller than the second size, which are smaller than the first size. Likewise, portions of the garment structure having openings of the first size or larger also may include other openings of any desired size(s). Moreover, not all of the openings in a given portion of the garment structure need to correspond to the various size requirements set forth above. For example, portions of the garment structure designated as having openings smaller than the first size also may include at least some openings that are larger than the first size, in at least some examples of this invention. Likewise, portions of the garment structure designated as having openings of the first size or larger also may include at least some openings smaller than the first size, in at least some examples of this invention. Many variations in the opening sizes and shapes in the various portions of the garment structure may be used without departing from the invention.

Garments having targeted venting zones in accordance with at least some additional example aspects of this invention may include, for example: a first fabric panel; and a pattern of openings defined in the first fabric panel, wherein the pattern of openings is defined based on a thermal profile of a body (e.g., infrared based imaging), wherein the thermal profile distinguishes between areas of the body having different thermal characteristics. In at least some examples, the thermal profile will define at least a first area of the body having a first thermal characteristic and a second area of the body having a second thermal characteristic, and the pattern of openings will define locations for plural openings of a first size corresponding to the first area and locations for plural openings of a second size corresponding to the second area. If desired, additional openings of additional sizes also may be provided at locations corresponding to other areas of the body that have still different thermal characteristics, e.g., based on the thermal profile, without departing from the invention.

The "thermal characteristics" of a body may represent, at least in part, different heat release characteristics, such as quantifications (absolute or relative) of the amounts of heat released at the different areas of the body, e.g., some areas of the body may release more heat than other areas. By ascertaining the heat release characteristics associated with a body (e.g., using infrared imaging), openings of different sizes may be arranged in a pattern in the garment structure such that larger sized openings are provided at areas of the body that release the most heat and smaller sized openings are provided at areas of the body that release less heat. In this manner, the garment structure provides openings arranged to better help cool the athlete's body.

If desired, in at least some examples of the invention, the thermal profile for the body may be measured or determined during or after (e.g., immediately after) the body is engaged in a particular type of exercise, event, or activity. In this manner, the pattern of openings may be better customized to a particular user's body and/or to a particular type of exercise, event, or activity. For example, the thermal profile of a body may depend, at least in part, on at least one physical characteristic associated with the body, such as body size (e.g., small, medium, large, extra large, etc.), body weight, physical build type (e.g., slender, average, stocky, heavy, etc.), body height, body age, etc. As another example, the thermal profile of an individual body or body type may differ depending on the type of activity in which the user is involved, e.g., whether the user is involved in sprinting, running, jogging, walking, rowing, crew, weight lifting, various team sports, etc. As still another example, the thermal profile of an individual body or body type may differ depending on the environment in which the activity takes place, e.g., indoors, outdoors, ambient temperature, ambient humidity, wind speed, wind direction, etc. If desired, the pattern of openings may be specifically derived from the thermal profile generated by the ultimate garment user's body while engaged in the specific type of exercise, event, or activity (or immediately after being engaged in the specific type of exercise, event, or activity) so that the garment openings can be specifically custom designed for the user's body and/or the particular anticipated end use of the garment.

Targeted and zoned venting, like that described above, helps keep an athlete cooler by increasing air flow and/or heat release over various targeted regions of the body that typically release the most heat (e.g., based on thermal profiles). The body releases a significant amount of its excess heat in certain areas, and an open garment structure and increased air flow in these areas, via targeted and zoned venting, help speed up the evaporation of sweat from the skin, and hence, help speed up the evaporative cooling process (as described above). Additionally, the open structure and improved air flow help move fresh and relatively cool air into the targeted areas and help move the heated air out.

Additional aspects of the invention relate to methods for developing vent opening patterns and garments having targeted vent opening patterns, e.g., like those described above. Such methods may include, for example: (a) determining a thermal profile of a body, wherein the thermal profile defines at least a first area of the body having a first thermal characteristic and a second area of the body having a second thermal characteristic (for example, the thermal characteristics may represent, at least in part, amounts of heat released at different areas of the body); (b) forming fabric into a garment structure; and (c) producing plural openings in the fabric based on the thermal profile, wherein plural openings of a first size are produced in a first portion of the fabric at one or more locations corresponding to the first area, and wherein plural openings of a second size are produced in a second portion of the fabric at one or more locations corresponding to the second area. Of course, additional opening sizes for other areas of the body (e.g., those areas with still different thermal characteristics) may be produced in the fabric based on the thermal profile without departing from this invention. These steps may take place in any order without departing from the invention (e.g., the garment may be formed before or after the openings are produced and/or before or after the thermal profile is obtained; some openings may be formed before the garment is produced and some may be formed after it is produced; etc.).

Additional method aspects of the invention include: (a) determining a thermal profile of a body, wherein the thermal profile defines at least a first area of the body having a first thermal characteristic and a second area of the body having a second thermal characteristic; and (b) developing an opening pattern based on the thermal profile, wherein the opening pattern defines locations for plural openings of a first size in a garment structure at locations corresponding to the first area and locations for plural openings of a second size at locations corresponding to the second area. Optionally, additional openings of still other sizes also may be defined in the pattern, e.g., based on areas of the body having still different thermal characteristics as ascertained from the thermal profile. At least some example methods according to this aspect of the invention further may include forming the garment structure with plural openings in the fabric based on the opening pattern.

Still additional example aspects of this invention relate to methods of producing collections, catalogs, or libraries of opening patterns. Such collections of patterns may be used by individuals or others to help select and customize an opening pattern to be provided on a specific garment, e.g., to target the opening pattern to the specific body characteristics, body type, and/or ultimate end use(s) or condition(s) to which the garment will be exposed. Such methods may include, for example: (a) determining plural thermal profiles, wherein individual thermal profiles of the plural thermal profiles are determined, cataloged, and/or stored with data relating to at least one of different respective body types, different respective types of exercises, different respective types of events, or different respective types of activities; and (b) developing plural opening patterns for plural garment structures based on the plural thermal profiles such that an individual opening pattern corresponds to a respective individual thermal profile. The plural opening patterns will, in effect, provide a collection, catalog, or library of different opening patterns correlated by at least one of different body types, different types of exercises, different types of events, or different types of activities, etc. Data relating to a specific garment user's body type and/or the ultimate end use of the garment may be collected and matched to the data stored in the collection or library of opening patterns to find the closest match. The garment then may be produced with plural openings of various different sizes in the pattern that most closely matches the user's body type, body characteristics, and/or the ultimate end use for the garment. Optionally, if desired, aspects of the opening pattern may be modified before the garment is formed, e.g., to extrapolate from and/or interpolate between the stored patterns and thereby better match the final pattern to the user's body type or other characteristics (e.g., if the selected opening pattern is derived from someone 5'10" but the specific user is 5'8," the pattern may be modified somewhat to correspond to the garment user's actual height (e.g., to proportionally change all opening sizes and/or separation distances along the pattern's height dimension)).

Thermal profiling, as described above, also may be used in substantially the same manner to produce garments that include targeted zones to help better insulate the garment or retain heat with the wearer's body (e.g., for use in cool or cold conditions). For example, rather than providing vent openings at areas of the body that release a large amount of heat, additional insulation material or other materials that help retain heat may be provided at these targeted areas of the garment structure to help keep heat close to the wearer's body. Garments in accordance with at least some examples of this aspect of the invention may include: a first fabric panel, and a pattern of plural discrete areas of increased insulation or heat retention capability defined in the first fabric panel. Again, this pattern may be defined or determined based on a thermal profile of a body, wherein the thermal profile distinguishes between areas of the body having different thermal characteristics (e.g., the thermal profile may define at least a first area of the body having a first thermal characteristic and a second area of the body having a second thermal characteristic). The pattern of areas of increased insulation or heat retention capability may define a location for at least a first area of increased insulation or heat retention capability in a garment structure corresponding to the first area of the thermal profile and a location for at least a second area of increased insulation or heat retention capability in the garment structure corresponding to the second area of the thermal profile.

Further aspects of the invention relate to methods for forming garments having targeted areas of increased insulation or heat retention capability. Such methods may include, for example: (a) determining a thermal profile of a body, wherein the thermal profile distinguishes between areas of the body having different thermal characteristics, and wherein the thermal profile defines at least a first area of the body having a first thermal characteristic and a second area of the body having a second thermal characteristic; (b) forming fabric into a garment structure; and (c) producing plural discrete areas of increased insulation or heat retention capability in the fabric based on the thermal profile wherein at least a first discrete area of increased insulation or heat retention capability is produced in a first portion of the fabric at a location corresponding to the first area, and wherein at least a second discrete area of increased insulation or heat retention capability is produced in a second portion of the fabric at a location corresponding to the second area.

Other aspects of the invention relate to methods for providing patterns of areas of increased insulation or heat retention capabilities for use in garment structures. Such methods may include, for example: (a) determining a thermal profile of a body, wherein the thermal profile distinguishes between areas of the body having different thermal characteristics, and wherein the thermal profile defines at least a first area of the body having a first thermal characteristic and a second area of the body having a second thermal characteristic; and (b) developing a pattern of plural discrete areas of increased insulation or heat retention capability based on the thermal profile, wherein the pattern defines locations for at least first and second discrete areas of increased insulation or heat retention capability in a garment structure corresponding to the first and second areas of the body, respectively. Aspects of the invention further relate to garments produced including zones of increased insulation or heat retention capability based on the patterns.

Still other methods in accordance with examples of the invention involve producing a collection or library of thermal profiles, e.g., indexed by different body types, event types, exercise types, activity types, and the like. Such methods may include, for example: (a) determining plural thermal profiles, wherein individual thermal profiles of the plural thermal profiles are indexed based on at least one of different respective body types, different respective types of exercises, different respective types of events, or different respective types of activities, and wherein the individual thermal profiles distinguish between areas of a respective body having different thermal characteristics; and (b) developing plural patterns of plural discrete areas of increased insulation or heat retention capability for garment structures based on the thermal profiles such that an individual pattern corresponds to a respective individual thermal profile. These plural patterns will provide a collection or library of different patterns of plural discrete areas of increased insulation or heat retention capability indexed based on at least one of the different body types, the different types of exercises, the different types of athletic events, or the different types of activities. Aspects of this invention further relate to garments produced including zones of increased insulation or heat retention capability based on the patterns.

Of course, additional areas of the body having additional thermal characteristics, may be defined by the thermal profile in the various garments and methods described above, and the pattern of areas of increased insulation or heat retention capability may be adjusted to accommodate these additional areas of the body. Also, if desired, in at least some examples of the invention, the thermal profile may be determined during or after the body is engaged in a particular type of exercise, event, or activity. Additionally, if desired, garment structure may be custom designed for an individual user by taking the thermal profile of the individual and using that profile to product the pattern of areas of increased insulation or heat retention capability.

Still additional aspects of this invention relate to garments, opening patterns, collections of opening patterns, insulation or heat retaining material patterns, and collections of insulation or heat retaining material patterns produced by the various methods described above (and those described in more detail below).

Specific examples of the invention are described in more detail below. The reader should understand that these specific examples are set forth merely to illustrate examples of the invention, and they should not be construed as limiting the invention.

B. SPECIFIC EXAMPLES OF THE INVENTION

The figures in this application illustrate various examples of apparel and methods useful in accordance with at least some examples of this invention. When the same reference number appears in more than one drawing, that reference number is used consistently in this specification and the drawings to refer to the same or similar parts or elements throughout.

1. Targeted Cooling Zones

As described above, the human body releases heat, particularly when an individual is involved in physical exercise, athletic events, or other activities. Release of excess heat is imperative, as it can help keep the individual cool, improve performance, and/or prevent overheating and adverse health consequences that may arise due to overheating. The amount of heat released by a body can be qualitatively and quantitatively measured or displayed, e.g., using infrared imaging, "night vision," or other thermal profiling technology as in conventional and known in the art.

FIG. 1 illustrates an example thermal profile 100 of a human body in the form of an infrared image of the body that qualitatively and quantitatively indicates the amount of heat being released at various locations by the body. As is conventional, thermal profiles of this type use different colors or gray scale gradations (or other gradations or symbols) to at least partially quantify the amount of heat released by the body (at the very least, in at least some systems, the color or gray scale gradations or the like will indicate relative differences in the amount of heat released by one area of the body as compared to other areas of the body). In a typical color thermal profile of this type, the colors may range from black to blue to aqua to green to light green to yellow to orange to red to white (coolest to hottest). In the grayscale version of the thermal profile 100 in FIG. 1, the reference numbers correspond to various colors in the color thermal profile as follows:

| Reference Number | Color |
|---|---|
| 102 | Blue |
| 104 | Green |
| 106 | Yellow |
| 108 | Orange |
| 110 | Red |
| 112 | White |

While gray scaling, as shown in FIG. 1, may lose some of the finer gradations between the various areas or zones with different thermal characteristics, the gray scaled image of FIG. 1 generally illustrates the boundaries between areas that release more heat as compared to other areas. Of course, any type of thermal profiling, thermal imaging, storage, display, and/or use of thermal profiling or imaging data may be used without departing from the invention.

Figure 2:
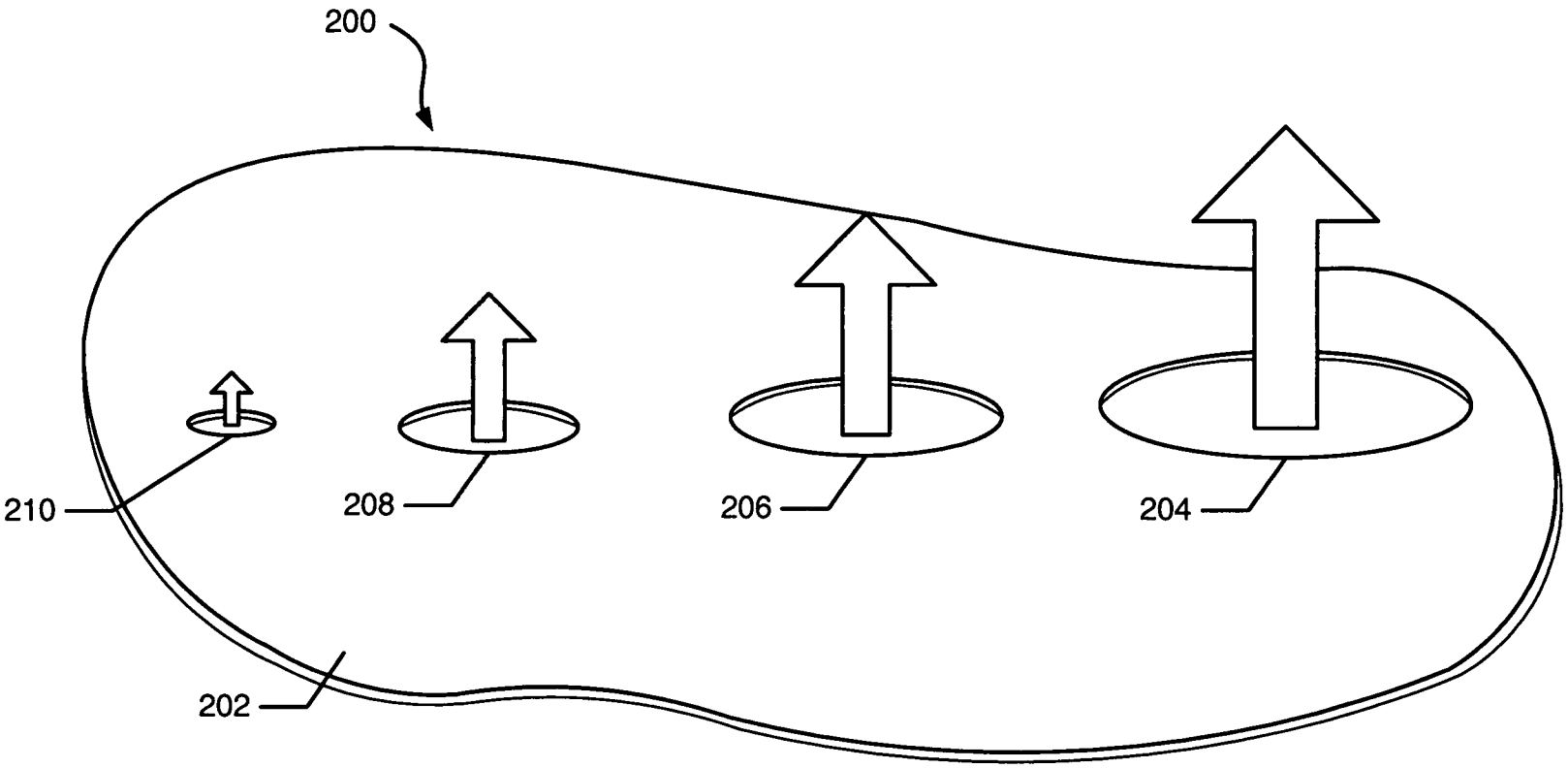
FIG. 2 generally illustrates various different opening structures for fabrics and is used in explaining various features and aspects of this invention.

Aspects and examples of this invention relate to garments that include targeted vent openings to help better release the body's heat. FIG. 2 helps explain aspects of the invention. As shown, a garment structure 200 includes a fabric panel 202 with a plurality of vent openings provided in it. In this example garment structure 200, the largest vent openings 204 generally are provided at locations in the garment structure 200 proximate to the areas of the body where the most heat is released (e.g., areas 112 and 110 in FIG. 1). Middle sized vent openings 206 and 208 generally are provided at locations in the garment structure 200 corresponding to areas of the body where a substantial amount of heat is released, but not as much heat as other areas (e.g., areas 108 and 106, respectively, in FIG. 1). The smallest openings 210 generally are provided at locations in the garment structure 200 corresponding to areas of the body that release still less heat than those associated with the middle sized openings 206 and 208 (e.g., areas 104 and 102 in FIG. 1). If desired, in at least some examples of the invention, the smallest openings in the garment structure 200 (e.g., openings 210 in FIG. 2) may constitute the conventional mesh openings provided in some types of fabrics for athletic clothing, e.g., materials conventionally used for jerseys or the like. While the openings 204-210 are shown as round in FIG. 2, those skilled in the art will recognize, of course, that the openings may be of any desired shape, including mixtures of two or more different shapes, without departing from the invention.

The arrows in FIG. 2 indicate air moving through the openings 204, 206, 208, and 210. The larger the hole, the more air that moves through it (and the more heat released through it), which creates more effective and efficient evaporative cooling. By targeting the locations of the larger holes to areas of the body that release more heat, evaporative cooling further improves at the areas of the body most in need of cooling.

Figure 3:
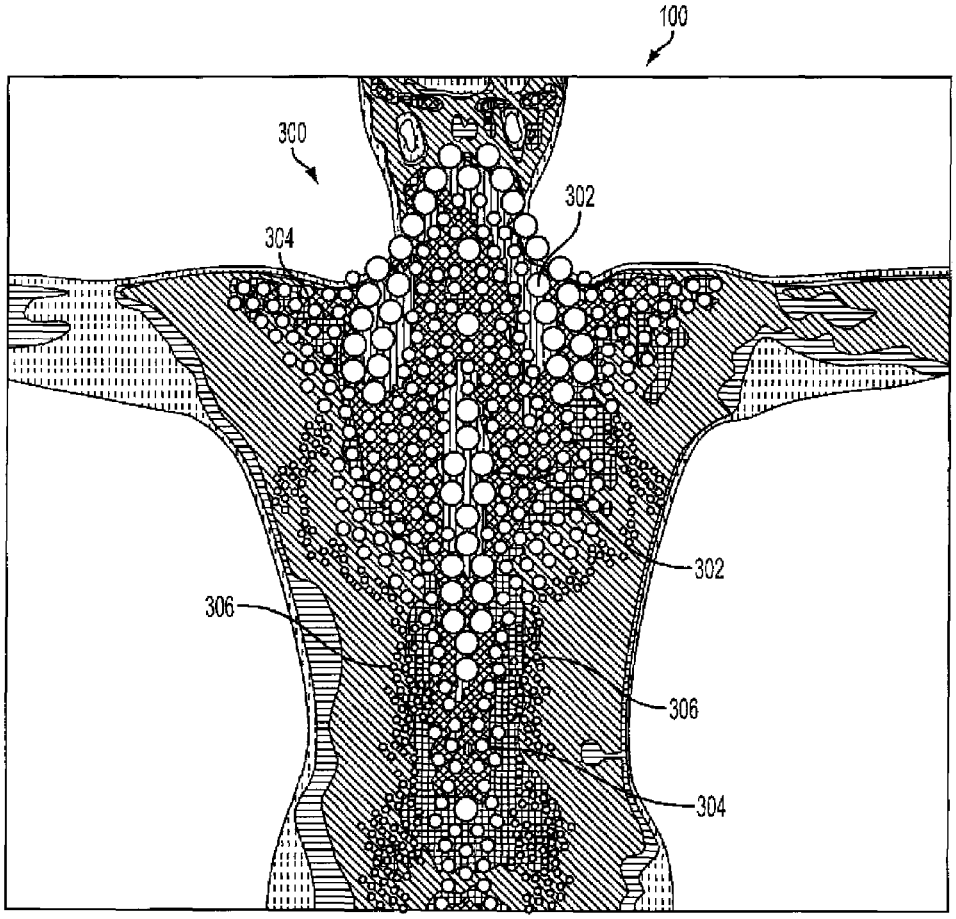
FIG. 3 illustrates an example of a thermal profile (e.g., an infrared based image) of an individual or overlaid with a garment opening pattern derived from it in accordance with an example of this invention.

FIG. 3 illustrates the thermal profile 100 of FIG. 1 with a vent opening pattern 300 overlaid on it. The locations and sizes of the vent openings in the vent opening pattern 300 were derived and determined, at least in part, based on the thermal profile 100 and the amounts of heat released from the body at various locations. More particularly, as shown in FIG. 3, the vent opening pattern 300 was designed such that the largest openings 302 are provided proximate to the locations on the body where the most heat is released (e.g., generally corresponding to areas 110 and 112 in FIG. 1). Smaller openings 304 are provided proximate to locations of the body where a substantial amount of heat is released from the body, but not as much as areas 110 and 112 (e.g., proximate area 108 in FIG. 1), and still smaller openings 306 are provided proximate to locations where still less heat is released (e.g., proximate to area 106 in FIG. 1). While the example illustrated in FIG. 3 shows no openings specifically targeted to the cooler areas of the body (e.g., areas that release less heat, proximate to areas 102 and 104 in FIG. 1), if desired, additional and generally smaller openings may be provided in these areas without departing from the invention (indeed, any number of individual opening sizes and/or shapes may be provided and used in a garment structure without departing from the invention). As another example or alternative, if desired, the fabric located proximate to the cooler areas of the body (e.g., proximate to areas 102 and 104 in FIG. 1) may be a conventional type mesh fabric having very small openings and/or other conventional breathable fabric. Additionally, the fabric between the larger openings 302, 304, and 306 (and hence the base fabric for the overall garment structure) may be a mesh fabric, another breathable fabric, and/or any other desired type of fabric, without departing from this invention.

As shown in FIG. 3, there is no need for exact one-to-one correspondence between the thermal characteristics of the body (as evidenced by the colors of thermal profile 100) and the sizes and locations of all openings in the opening pattern 300. Rather, the opening pattern 300, including the opening locations and sizes, are generally based on the thermal profile 100. Some variation in opening sizes and locations may be possible without departing from the invention. For example, to ensure that the garment has adequate material and strength to maintain its structural integrity, some portions of the garment located proximate to a relatively high heat release area of the body may have at least some smaller openings (e.g., too many openings too close together may cause the garment to tear too easily). Also, the sizes and locations of some openings may depend, at least in part, on thermal characteristics associated with closely adjacent areas and/or the thermal gradient surrounding a given area (e.g., a small high heat release area adjacent to a large, less heat release area may not warrant a large number of large sized openings).

Figure 4:
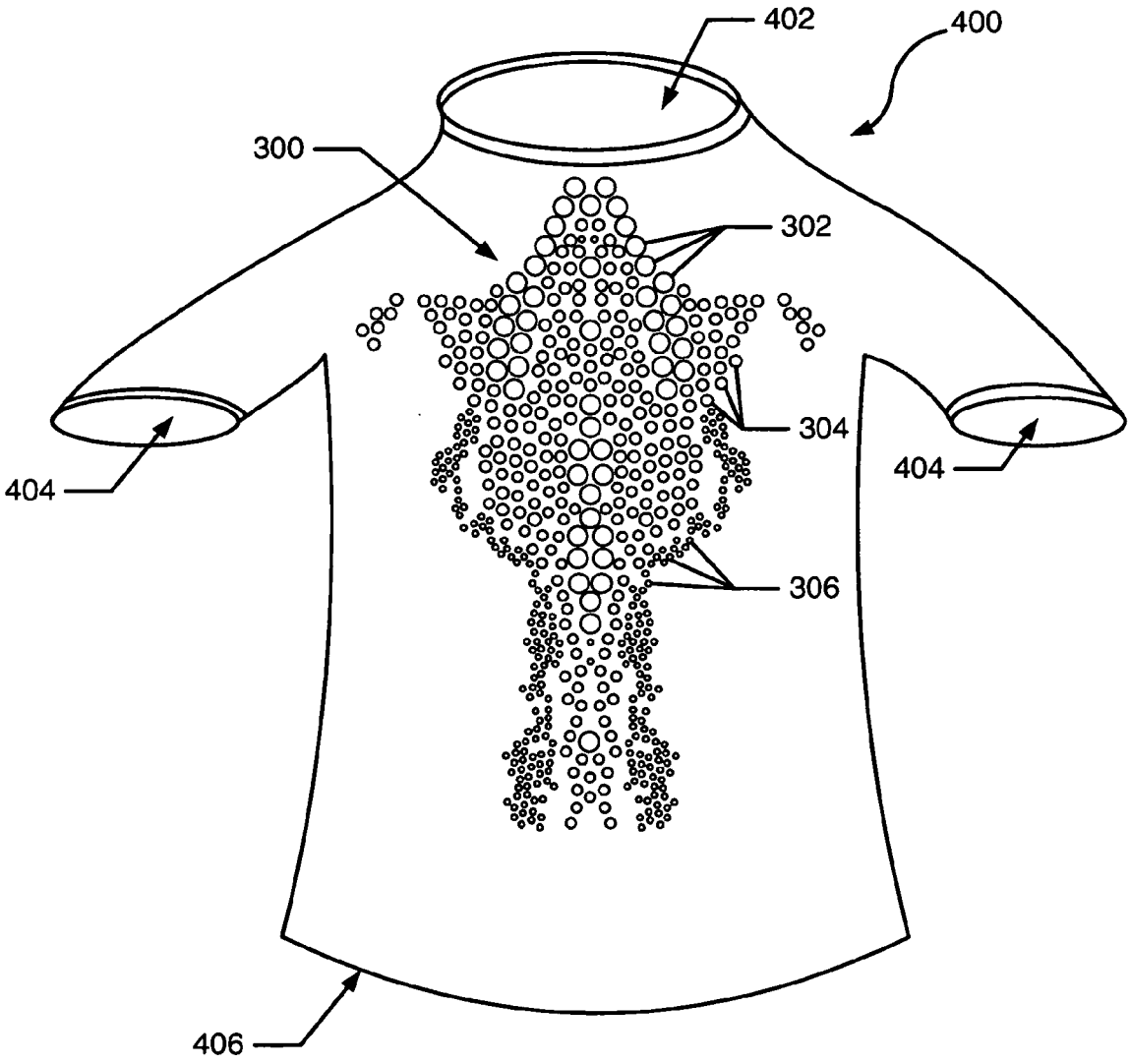
FIG. 4 illustrates an example of an upper torso garment in accordance with the invention having a vent opening pattern based on a thermal profile.

FIG. 4 illustrates an example garment 400 in accordance with one example of this invention for at least partially fitting an upper torso of a wearer. The garment 400 includes a head or neck opening 402, two arm openings 404, and a waist opening 406, as is conventional and known in the art. While the garment 400 is shown as a short-sleeved athletic jersey, any desired garment style may be used without departing from the invention, including, for example: a longer sleeved jersey; a tank top type jersey; a tight, body-fitting jersey or other garment, such as a track suit, wrestling uniform, or leotard; and the like.

The garment 400 includes a vented zone that includes the vent opening pattern 300 generally derived from a thermal profile, such as thermal profile 100, as shown in FIG. 3. Notably, in general, the opening pattern 300 and the various individual openings 302, 304, and 306 are located and sized such that when the garment 400 is worn, the larger openings 302 generally will be located proximate to and adjacent areas of the body that release the most heat, the mid-sized openings 304 generally will be located proximate to and adjacent areas of the body that release the mid-range amounts of heat, and the smaller openings 306 generally will be located proximate to and adjacent areas of the body that release a lesser amount of heat. As noted above, however, if desired, additional openings of additional different sizes and/or at additional locations may be provided in the garment structure 400 without departing from this invention.

In general, as illustrated in FIG. 4, the opening pattern 300 generally extends along a center back portion of the garment structure 400 (i.e., along the garment wearer's spine). The opening pattern 300 generally may be of any suitable or desired size, shape, arrangement, or dimensions without departing from the invention, for example, depending on the body characteristics or body type of the garment user, the ultimate end use of the garment, the expected level of exertion produced when using the garment, the thermal profile 100, the typical or expected ambient conditions, and the like. As one example or another alternative, if desired, an opening pattern of some type may be provided on the front and/or side portions of the garment structure 400 without departing from this invention.

Figure 5:
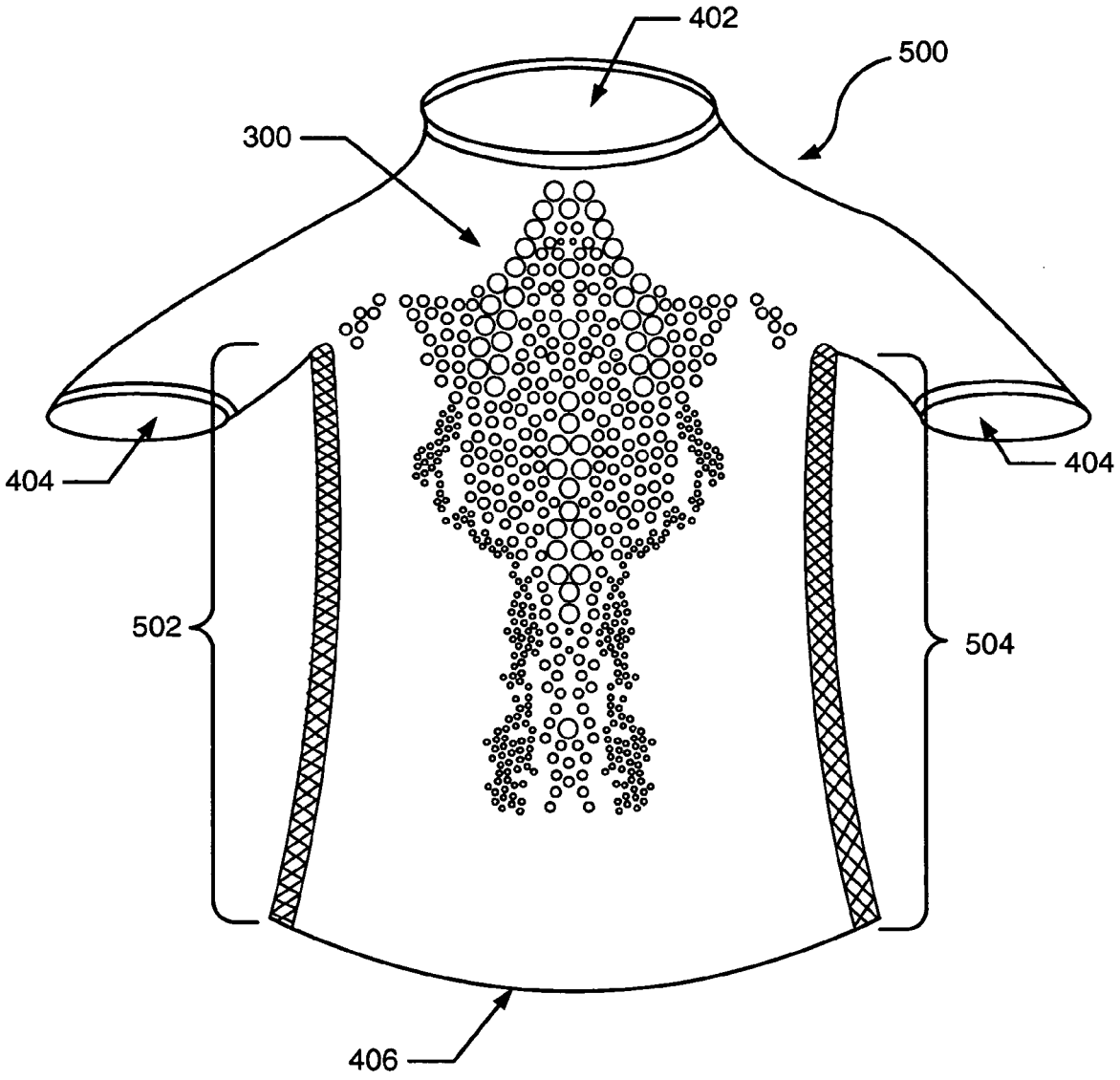
FIG. 5 illustrates an example of an upper torso garment in accordance with the invention having a vent opening pattern based on a thermal profile and additional side vent zones.

FIG. 5 illustrates another example garment structure 500. In this illustrated example, the garment structure 500 includes both a back, center vent opening pattern 300, e.g., like that derived from the thermal profile 100 described above, and two side vented zones 502 and 504. The side vented zones 502 and 504 may be made from a mesh material or other material having openings, including openings derived from a thermal profile of a body like those provided in the opening pattern 300 described above. While the illustrated example garment structure 500 shows the side vented zones 502 and 504 extending all the way or closely proximate to the waist opening 406, these vented zones 502 and 504 (as well as the vent opening pattern 300) can take on any suitable or desired dimensions, size, arrangement, and shape without departing from the invention. As some more specific examples, one or more of the side vented zones 502 and 504 could end generally in a waist area of the garment structure 500 (rather than at or proximate to the waist opening 406), one or both of the side vented zones 502 and 504 could extend all the way to the arm openings 404, or the like.

Zoned venting, like that described above in conjunction with FIG. 5, may further help keep an athlete cooler by increasing air flow over various targeted regions of the body (e.g., air may enter from the two sides and move under the garment to the center back area). As noted from the thermal profile 100, the body releases a significant amount of its excess heat at a person's center back area, and increased air flow in this region from the sides to the center back area, via zoned venting, helps speed up the evaporation of sweat from the skin, and hence, helps speed up the evaporative cooling process (as described above). Additionally, this improved air flow path (from the sides to the center back) helps move fresh, relatively cool, and relatively un-humidified air into the targeted regions and helps move the heated and relatively humidified air out. Vented zones at the athlete's sides, like vented zones 502 and 504, also help improve air intake and air flow as described above when the body is moving forward and/or laterally and/or during other movement that typically occurs during exercise and/or athletic events.

Figure 6:
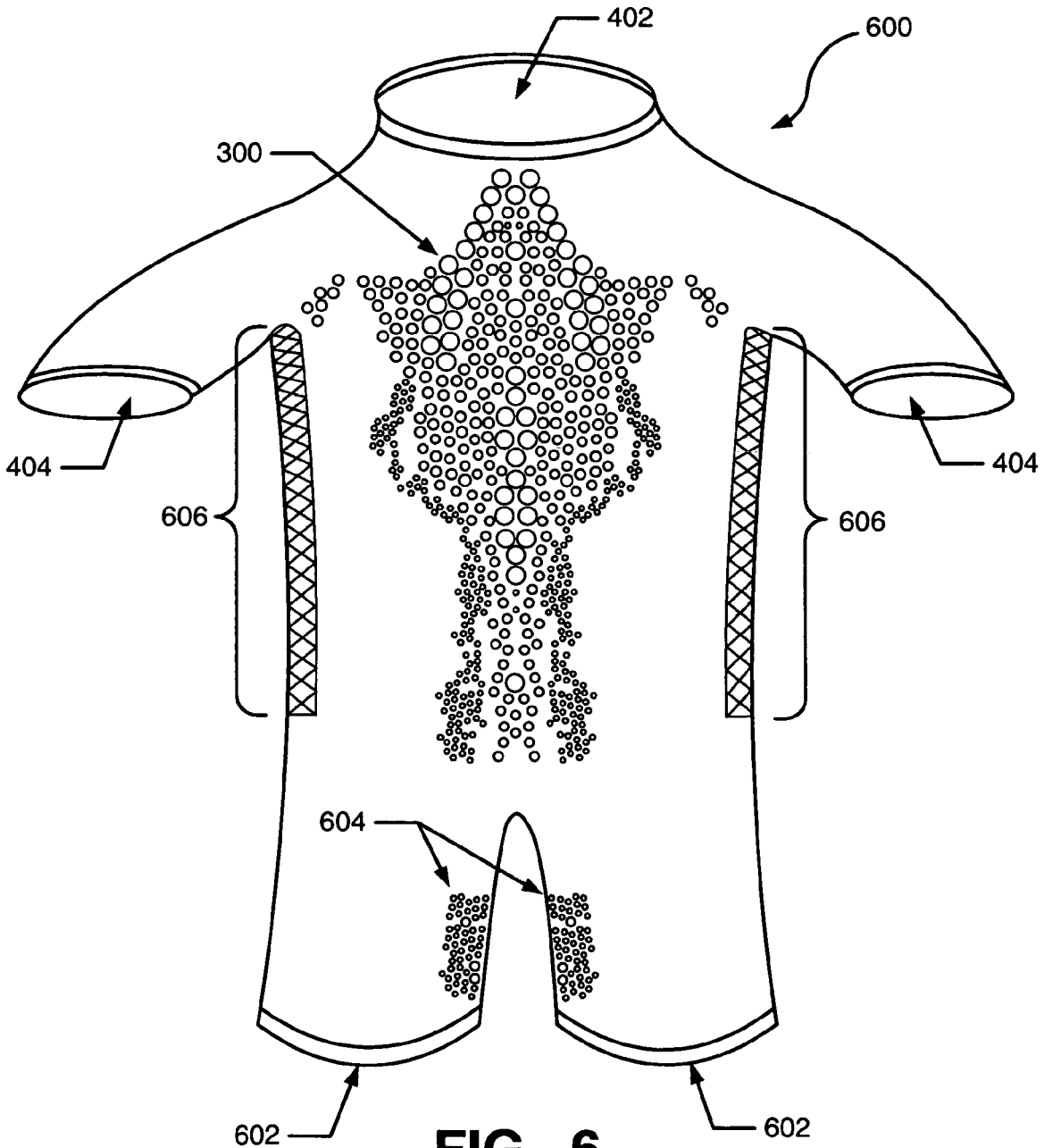
FIG. 6 illustrates an example of a leotard or track suit type garment in accordance with the invention having vent opening patterns based on a thermal profile and additional side vent zones.

Aspects of this invention are not limited to use with jerseys, tank tops, and other garments that cover only the wearer's upper torso. FIG. 6 illustrates another example garment structure 600 in which aspects of the invention may be used. In FIG. 6, the garment 600 is a leotard or track suit type garment that at least partially covers both the wearer's upper torso and lower torso. As illustrated, this example garment structure 600 includes a neck or head opening 402, two arm openings 404, and two leg openings 602. Conventional openings and/or fastening mechanisms at the front and/or back of the garment structure 600 (not shown) may be provided to allow user entry into the garment structure 600. In this example, the garment structure 600 includes a center back vent opening pattern 300 like that derived above in connection with the thermal profile 100 of FIGS. 1 and 3. If necessary or desired, e.g., based on a thermal profile, additional vent openings may be provided in the garment structure 600 and/or additional vent opening patterns may be derived for other areas of the garment structure 600, such as the opening patterns 604 shown in FIG. 6.

The garment structure 600 of FIG. 6 further includes two side vented zones 606, e.g., made of a mesh material, made with openings like those in opening patterns 300 and 604, or made with any other desired mesh, opening, or breathable fabric arrangement. Of course, any suitable or desired size, shape, arrangement, and dimensions may be used for the various vented zones and/or vent opening patterns 300, 604, and 606 without departing from the invention, including various sizes, shapes, arrangements, and dimensions derived from thermal profiles as described above. The various vented zones in a garment structure (e.g., the center back vented zone 300 and/or one or more the side vented zones 606) also may be continuous or discontinuous, for example, over their width and/or length and/or other dimensions, without departing from the invention.

The openings, vented zones, and/or mesh openings may be provided in garment structures in any desired manner without departing from the invention, including in conventional manners known in the art. If desired, for example, the entire garment may be made from a single type of material (and even from a single piece of material) in at least some examples of the invention, but the fabric material provided in the vented zones of the garment may be processed or otherwise altered to include the openings. Such processing may include, for example: laser treatments (to perforate the material and/or provide the openings or mesh structures); calendaring, rolling, die cutting, and/or other physical treatments to perforate the material and/or provide the openings and/or mesh structure; and the like. The openings also may be formed in the material as part of the garment or fabric production process, such as during knitting, weaving, or the like. The processing or other activity to create the openings in the garment structure, if any, may take place either before or after the actual garment structure is formed (e.g., before or after the garment is sewn together) and/or as an initial intermediate, and/or final step during a garment formation procedure, and/or at any other time or in any other desired order, without departing from the invention.

In still other examples, garments in accordance with the invention may be made such that different types of material (and/or different pieces of material) make up the various portions of the garment structure. Such pieces of material may be sewn and/or otherwise joined together to form a garment structure in any suitable or desired manner without departing from the invention, including in conventional manners known in the art. Any desired number of different types of materials and/or materials having different openings and/or mesh patterns may be included in garments without departing from the invention. Additionally, if desired, the materials used for creating the various regions including the opening patterns and/or the vented zones may be the same or different within a single garment, and, if desired, the various different regions with opening patterns and/or vented zones may have different air permeability characteristics with respect to one another within a single garment.

Examples of suitable materials for use in producing garments in accordance with aspects of the invention include any desired natural, synthetic, or blended materials or combinations thereof, in any desired configuration, style, or combination. More specific examples of suitable materials include: leathers, cotton materials, wool materials, silk materials, polyesters, vinyls, nylons, rubbers, spandex, polyester microfibers, polyester microfiber cotton blends, polyester microfiber cotton spandex blends, and the like. Examples of suitable styles or configurations of garments in accordance with examples of the invention include: T-shirts, jerseys, pants, or track suit type garments (like those described above), of any desired size and/or style, optionally sleeveless, short-sleeved, long-sleeved, with removable sleeves, with removable pant legs, etc.

In at least some examples of the invention, the garment product may be constructed from high-performance sweat management materials (e.g., like thin, lightweight fabrics made from or containing polyester microfibers, polyester microfiber cotton blends, polyester microfiber cotton spandex blends, polyester spandex blends, and the like). In some more specific examples, apparel in accordance with at least some example aspects of this invention may be made from or include a "Sphere Dry" polyester knit material and/or a Dri-FIT polyester material, as included in various commercial products available from NIKE, Inc., of Beaverton, Oreg. The garment material may be knitted, woven, and/or formed or constructed in any suitable or desired manner, including in conventional manners known in the art.

Figure 7:
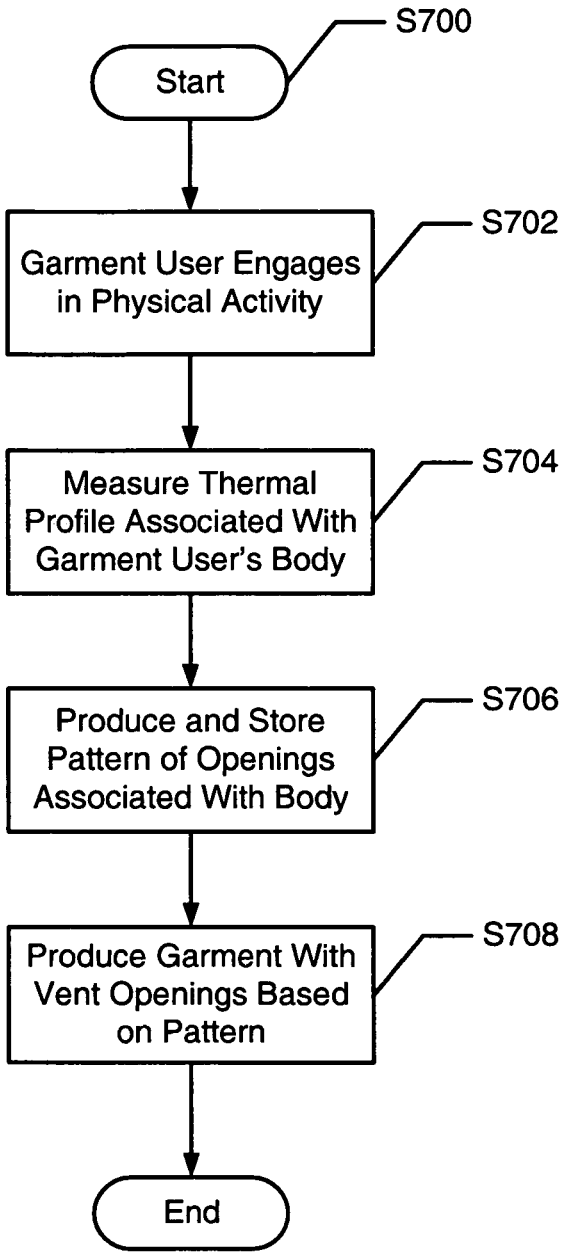
FIG. 7 includes a flow diagram illustrating example steps in a procedure for providing a garment with customized vent opening patterns in accordance with one example of this invention.

Additional aspects of the invention relate to methods for deriving opening patterns for garments and/or for forming garments including such opening patterns. FIG. 7 illustrates one example procedure in accordance with aspects of the invention in which customizable opening patterns may be generated. When this procedure starts (S700), a person for whom a garment is being designed and prepared first engages in physical activity (S702). Optionally, in at least some instances, the person will engage in the same physical activity, with the same general intensity and under the same general conditions, for which the garment is intended to be used. During or after the activity, when the person's body has heated up as a result of the exertion, a thermal profile (such as an infrared image of the type illustrated in FIG. 1) will be taken of the person's body (S704). The thermal profile may correspond to all or just some portion of the user's body (e.g., the upper torso and/or any other portion to be covered by the garment). From the thermal profile, a pattern of openings may be derived for at least a portion of the garment structure (S706), such as the back and/or sides of the garment (e.g., as shown in FIG. 3), and this pattern may be stored or finalized in some manner (e.g., produced as a hard copy, stored on computer, etc.). The pattern may be created manually by visually looking at the thermal profile and/or with the aid of a computer algorithm (e.g., wherein the algorithm helps locate openings of various different sizes at appropriate locations based on the body's heat release as available from the thermal profile). Once the vent opening pattern is created at S706, one or more garments may be produced for the user, wherein the garments include vent openings, at least in a portion thereof, based on the opening pattern derived at S706 (S708).

Of course, many variations in this procedure are possible without departing from the invention. For example, there is no need for actual production of a hard or soft copy of the underlying thermal profile. Rather, if desired, a computer algorithm may be designed for use in conjunction with the thermal imaging system such that an opening pattern or design is immediately created from the thermal profile information. In other words, there is no need for the system to actually visually display and/or store the thermal profile. As another example, there is no need for the system to actually store and/or physically create a hard or soft copy of the opening pattern. Rather, if desired, the pattern could be immediately embodied in the fabric for the garment without creating or storing a lasting non-fabric pattern. As still another example, the garment structure may be created with the desired opening pattern directly from a thermal profile without the need for creating and/or storing the separate opening pattern.

The above example also indicates that the opening pattern and the garment were produced from and customized for the actual person from whom the thermal profile was generated. While this is possible in accordance with examples of the invention, this feature is not required in all examples of the invention. For example, if desired, thermal profiles may be generated from the bodies of surrogates or models and/or the opening patterns generated from the surrogates may be used for producing garments for others, e.g., to produce garments for persons with body types similar to those of the surrogates. For example, using thermal profiles from surrogates of different sizes, weights, heights, body types (e.g., slim, medium, stocky, or heavy builds), fitness levels, etc., sets of opening patterns may be derived for a variety of potential customers (e.g., customers of different sizes, weights, heights, and body types), and clothing products may be mass produced and specifically targeted to this variety of customers. For example, a manufacturer may produce a line of clothing of various sizes in which tags on or containers for the clothing indicate the body type to which the opening pattern on that piece of clothing is suited (e.g., a tag on the garment may indicate that the garment size is extra large and that the vent opening pattern is designed for persons between 5'10" and 5'11" and weighing 220-240 pounds, whereas a tag on another extra large sized garment may indicate that the vent opening pattern is designed for persons between 6'4" and 6'5" and weighing 220-240 pounds). In this manner, vent openings in clothing can be better targeted to users with different body types without the need to take a thermal profile of and custom fit each individual user.

As another example, if desired, a thermal profile from one person (e.g., an actual user or surrogate) may be used, at least in some instances, to generate opening patterns for users having different body types. For example, the thermal profile and/or the opening pattern generated therefrom for a person of medium build and a height of 5'10" may be scaled (e.g., proportionally adjusted) for use to produce larger or smaller garments for other persons of the same general medium build body type. Other types of scaling, interpolation, and/or extrapolation based on known patterns and/or known thermal profiles may be possible without departing from this invention.

Figure 8:
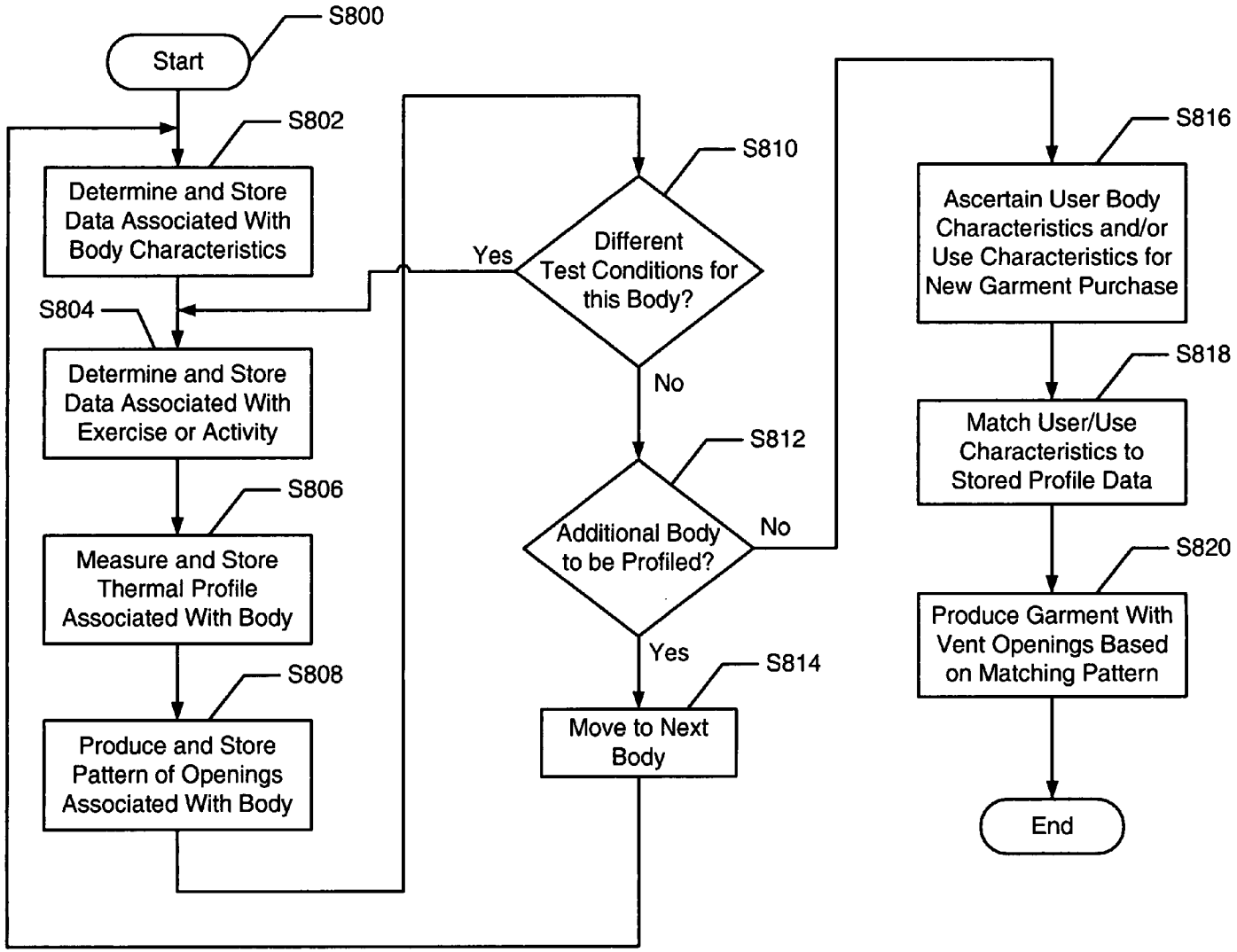
FIG. 8 includes a flow diagram illustrating example steps in a procedure for providing collections or catalogues of vent opening patterns in accordance with one example of this invention.

FIG. 8 illustrates an example method for generating a collection of opening patterns in accordance with another example aspect of this invention. As the procedure starts (S800), a first body for thermal profiling is selected, for example, a surrogate or model from which one or more opening patterns for various garments will be derived and generated. Data associated with this body, e.g, relating to the body's characteristics, are determined and stored (S802). Examples of information that may be stored relating to the body include gender, height, weight, build characteristics, age, measurements (chest, size, inseam length, waist size, etc.), and the like.

To at least some extent, athletes and/or others engaged in physical activity or athletic events may release heat at somewhat different regions of the body depending, at least in part, on the type of activity in which they are engaged and/or other characteristics associated with the activity. For example, a person may release heat somewhat differently (e.g., in different regions of the body) when involved in running or jogging as compared to when they are involved in weight lifting, rowing, or other activities. Accordingly, the person's thermal profile (and hence the most effective or optimum vent opening pattern) may change or differ somewhat, e.g., depending on the type of activity in which the person is involved. As another example, the environment under which the activity takes place may affect the person's thermal profile when engaged in the activity. For example, the location (e.g., indoors or outdoors), weather conditions (e.g., temperature, humidity, wind conditions, precipitation, etc.), and the like, all may affect the thermal profile generated by an individual during the activity. Accordingly, at S804, data is collected and stored relating to the type of exercise or activity and/or the conditions under which the exercise or activity took place. Any desired data of this type may be collected, stored, and/or correlated with a thermal profile without departing from this invention.

At S806, the thermal profile for the body is measured and stored, correlated to the previously determined body characteristics and/or exercise or activity characteristics. The body may be involved in a specific exercise or activity before and/or during the time the thermal profile is measured. Based on the thermal profile, a vent opening pattern (e.g., like those described above) may be developed (e.g., manually, automatically using a computer algorithm, etc.) at S808. At this step, the desired vent opening pattern also may be stored and correlated with at least some of the previously determined body characteristics and/or exercise or activity characteristics.

As a next step in the procedure (S810), a determination is made whether there is any desire to use this surrogate or model for additional thermal profiling, for example, under different test conditions (e.g., for different athletic events, different types of exercise, different exercise or activity conditions, etc.). If "Yes," the procedure returns to S804 and data regarding the exercise or activity conditions is again stored and the procedure repeats. If "No" at S810, the procedure then determines whether there are additional surrogates or model bodies to be profiled at this time (S812). If "Yes," the new body for measurement is selected (S814), the procedure returns to S802, and data associated with the new body's characteristics are determined and/or stored. The procedure then repeats. If no additional bodies are available for profiling (answer "No" at S812), the collection of thermal profiles and/or opening patterns is complete (at least for the time being), and the procedure moves on to a "garment forming stage."

More specifically, in this example garment forming stage, a user seeks to obtain or purchase a new garment with vent openings better suited to his/her particular body type and/or the desired exercise or activity type. Accordingly, at S816, data relating to this user's body characteristics and/or the desired exercise or activity characteristics for use of the garment is ascertained or collected. This may be accomplished at any location and/or in any manner, for example, at a retail location, over the Internet, over the telephone, through a mail-in catalogue process, etc. Based on this collected data, an opening pattern that best matches the user's body characteristics and/or the anticipated use characteristics may be located from the previously stored opening patterns (S818). If no exact matches for the user's body type and/or the use characteristics are found, the data representing the closest match or matches may be used. Alternatively, if desired, changes to the opening patterns may be derived by scaling, extrapolating, or interpolating from known profiles, opening patterns, and/or data points (e.g., to change the overall length, width, spacing, sizes, etc., of the vent opening pattern). Once the final opening pattern is selected, determined, or otherwise derived, one or more garments may be produced with vent openings included therein based on the selected or derived opening pattern (S820).

2. Targeted Insulation or Heat Retaining Zones

Figure 9:
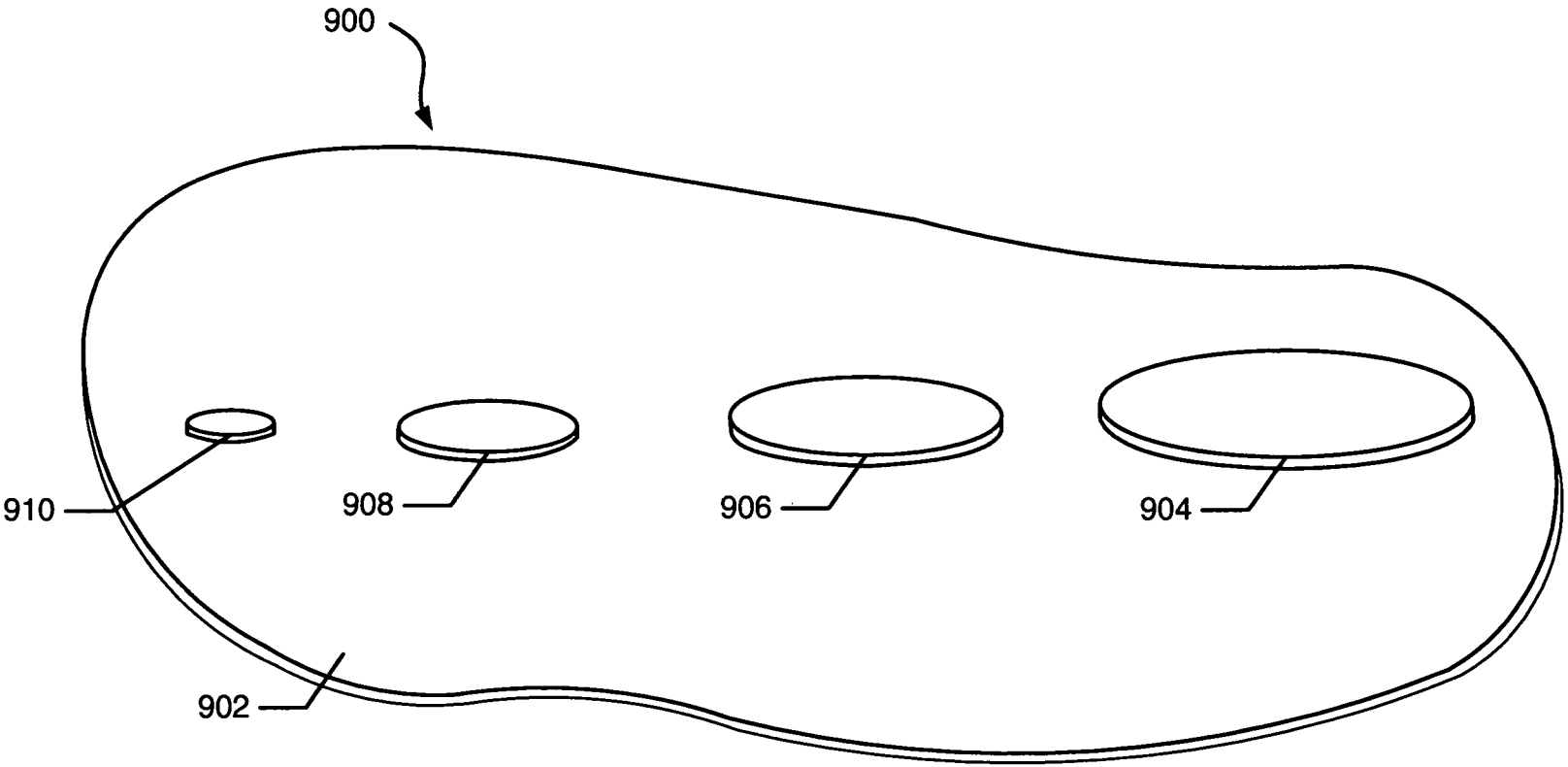
FIG. 9 generally illustrates structures for providing areas of increased insulation or heat retention capability in a garment in accordance with examples of this invention.

Thermal profiles, e.g., of the type illustrated in FIG. 1, also may be used in aspects and examples of this invention in which the garments include targeted insulation or heat-retaining areas to help keep a body warm (e.g., for use in cool or cold conditions). FIG. 9 helps explain these aspects of the invention. As shown, rather than providing vent openings as described above, a garment structure 900 in accordance with this example includes a fabric panel 902 with a plurality of additional insulation areas or heat-retaining material areas provided in or on it. In this example garment structure 900, the largest insulation or heat-retaining material areas 904 generally are provided at locations in the garment structure 900 proximate to the areas of the body where the most heat is released (e.g., areas 112 and 110 in FIG. 1). Middle sized insulation or heat-retaining material areas 906 and 908 generally are provided at locations in the garment structure 900 corresponding to areas of the body where a substantial amount of heat is released, but not as much heat as other areas (e.g., areas 108 and 106, respectively, in FIG. 1). The smallest insulation or heat-retaining material areas 910 generally are provided at locations in the garment structure 900 corresponding to areas of the body that release still less heat than those associated with the middle sized openings 906 and 908 (e.g., areas 104 and 102 in FIG. 1). In this manner, the additional insulation or heat-retaining materials are provided at locations that help keep the heat inside the garment and near the wearer's body. While the insulation or heat-retaining material areas 904-910 are shown as round in FIG. 9, those skilled in the art will recognize, of course, that these areas may be of any desired shape, including mixtures of two or more different shapes, without departing from the invention. If desired, the insulation or heat-retaining material areas may be irregularly shaped (e.g., based on the thermal profile) without departing from the invention.

If desired, a garment structure that includes patterns of targeted insulation or heat-retaining material areas as described above, based on a thermal profile, may appear similar to the structures shown in FIGS. 3-7, wherein the vent openings are replaced with areas containing additional insulation or heat-retaining material. If desired, the base fabric for the garment simply may include another layer of material at locations corresponding to the areas having additional insulation or heat-retaining material. Alternatively, if desired, the base fabric for the garment may be modified or treated so as to increase the insulative or heat-retaining properties of some portions of the garment with respect to other portions thereof (e.g., chemical treatment, laser treatment, heat treatment, or the like). If desired, as another alternative, different materials may be used at the areas having additional insulation or heat-retaining characteristics (as compared to the remainder of the material making up the garment structure). One advantage of providing additional insulation or heat-retaining materials at various individual discrete portions of the garment structure, e.g., as shown in FIGS. 3-7, may relate to the fact that the garment does not become excessively bulky or weighty. This feature can improve user performance, e.g., when the garment is used in exercise, athletic events, or other similar competitive activities.

Any type of fabric may be used for the garment structure and the additional insulation or heat-retaining material areas without departing from this invention, e.g., depending on the anticipated conditions of use, the typical physical exertion involved during use of the garment, etc. In some examples, conventional fabrics may be used as are known in the art. As noted above, if desired, the insulation or heat-retaining material areas (e.g., areas 904-910 in FIG. 9) may be provided by adding an additional layer of material over the base layer of material in the fabric (e.g., the same material, a material having improved insulation characteristics as compared to the base fabric material, a material having heat-reflecting or other heat-retaining characteristics, etc.). When provided as an additional layer, the additional layer of material may be provided on the inside of the garment structure and/or on the outside of the garment structure without departing from the invention. In still other examples, the insulation or heat-retaining material areas may be integrally formed as part of the base fabric material structure. If desired, the larger insulation or heat-retaining material areas may be made from materials that provide increased insulation or heat-retaining characteristics as compared to the materials making up the smaller insulation or heat-retaining material areas (e.g., the various insulative areas (small to large) may be made of progressively thicker layers of insulative material, if desired). In effect, the insulation or heat-retaining material areas will provide areas in the garment structure that have increased insulation and/or heat-retaining characteristics as compared to the characteristics of the base material making up the fabric.

If desired, in at least some examples of the invention, the "insulation" or "heat-retaining material" may be a material that actively applies heat to the wearer's body. In some examples, this insulation or heat-retaining material may include electrical resistive material that actively heats up (e.g., battery operated) or other material that actively heats up and/or reflects heat energy back to the wearer's body.

Figure 10:
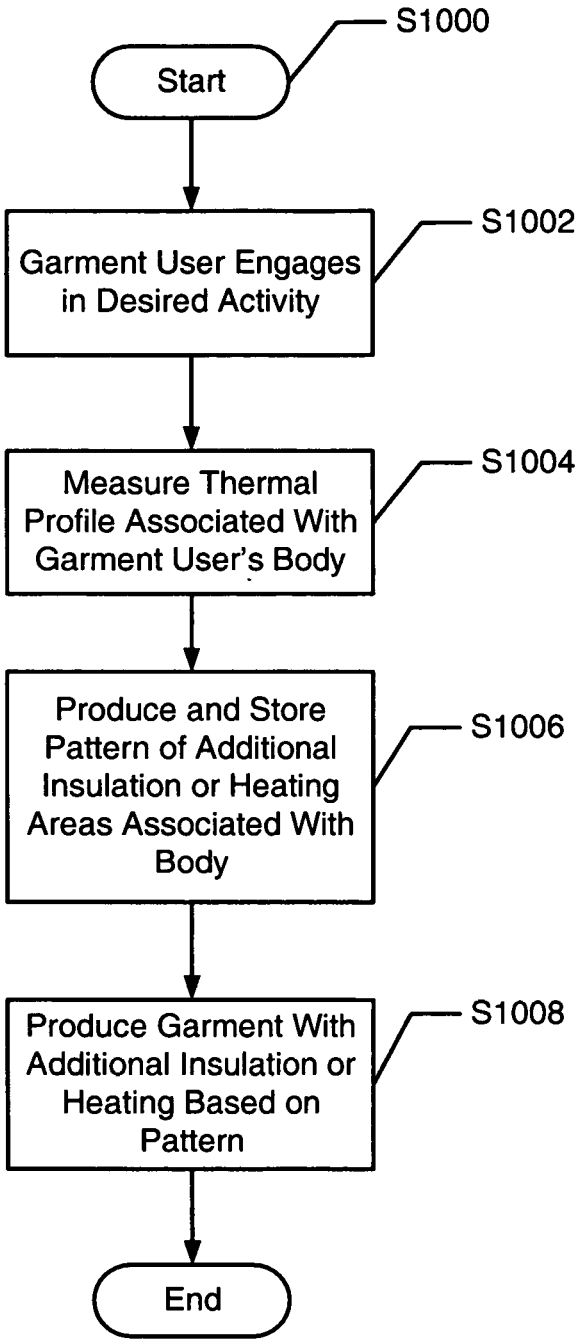
FIG. 10 includes a flow diagram illustrating example steps in a procedure for providing a garment with customized areas of increased insulation or heat retention capability in accordance with one example of this invention.

Additional aspects of the invention relate to methods for deriving patterns of materials having increased insulation or heat-retaining capabilities for garments and/or for forming garments including such patterns. FIG. 10 includes a flow chart illustrating one example procedure in accordance with aspects of the invention in which customizable patterns of increased insulation or heat-retaining capabilities may be generated. When this procedure starts (S1000), a person for whom a garment is being designed and prepared first engages in an activity (S1002). Optionally, in at least some instances, the person will engage in the same physical activity, with the same general intensity and under the same general conditions, for which the garment is intended to be used. During or after the activity, a thermal profile (such as an infrared image of the type illustrated in FIG. 1) will be taken of the person's body (S1004). The thermal profile may correspond to all or just some portion of the user's body (e.g., the upper torso and/or any other portion to be covered by the garment), and it indicates in at least some absolute, relative, and/or quantitative manner the areas of the body where heat is being released. From the thermal profile, a pattern of areas having increased insulation or heat-retaining capability for a garment structure may be derived (S1006). Such pattern may indicate that areas of increased insulation or heat-retaining capability should be provided at the back and/or sides of the garment (e.g., as shown in FIG. 3), and this pattern may be stored or finalized in some manner (e.g., produced as a hard copy, stored on computer, etc.). In at least some examples, the pattern may be created manually by visually looking at the thermal profile, and/or it may be created with the aid of a computer algorithm (e.g., wherein the algorithm helps locate areas of increased insulation or heat-retaining capability of various different sizes at appropriate locations based on the body's heat release as available from the thermal profile). Once the pattern is created at S1006, one or more garments may be produced for the user, wherein the garments include areas of increased insulation or heat-retaining capability, at least in a portion thereof, based on the derived pattern (S11008).

Of course, many variations in this procedure are possible without departing from the invention. For example, there is no need for actual production of a hard or soft copy of the underlying thermal profile. Rather, if desired, a computer algorithm may be designed for use in conjunction with the thermal imaging system such that an insulation or heat-retaining material pattern or design is immediately created from the thermal profile information. In other words, there is no need for the system to actually visually display and/or store the thermal profile. As another example, there is no need for the system to actually store and/or physically create a hard or soft copy of the pattern. Rather, if desired, the pattern could be immediately embodied in fabric for a garment without creating or storing a lasting non-fabric pattern. As still another example, the garment structure may be created with the desired pattern directly from a thermal profile without the need for creating and/or storing the separate pattern.

The above example also indicates that the pattern and the garment were produced from and customized for the actual person from whom the thermal profile was generated. While this is possible in accordance with examples of the invention, this feature is not required in all examples of the invention. For example, if desired, thermal profiles may be generated from the bodies of surrogates or models and/or the patterns generated from surrogates or models may be used for producing garments for others, e.g., to produce garments for persons with body types similar to those of the surrogates or models. For example, using thermal profiles from surrogates or models of different sizes, weights, heights, body types (e.g., slim, medium, stocky, or heavy builds), fitness levels, etc., sets of insulation or heat-retaining material patterns may be derived for a variety of potential customers (e.g., customers of different sizes, weights, heights, and body types), and clothing products may be mass produced and specifically targeted to this variety of customers. For example, a manufacturer may produce a line of clothing of various sizes in which tags on or containers for the clothing indicate the body type to which the pattern on that piece of clothing is suited (e.g., a tag on the garment may indicate that the garment size is extra large and that the insulation pattern is designed for persons between 5'10" and 5'11" and weighing 220-240 pounds, whereas a tag on another extra large sized garment may indicate that the insulation pattern is designed for persons between 6'4" and 6'5" and weighing 220-240 pounds). In this manner, the insulation patterns in clothing can be better targeted to users with different body types without the need to take a thermal profile of and custom fit each individual user.

As another example, if desired, a thermal profile from one person (e.g., an actual user or surrogate) may be used, at least in some instances, to generate insulation or heat-retaining material patterns for users having different body types. For example, the thermal profile and/or the insulation or heat-retaining material pattern generated therefrom for a person of medium build and a height of 5'10" may be scaled (e.g., proportionally adjusted) for use to produce larger or smaller garments for other persons of the same general medium build body type. Other types of scaling, interpolation, and/or extrapolation based on known patterns and/or known thermal profiles may be possible without departing from this invention.

Figure 11:
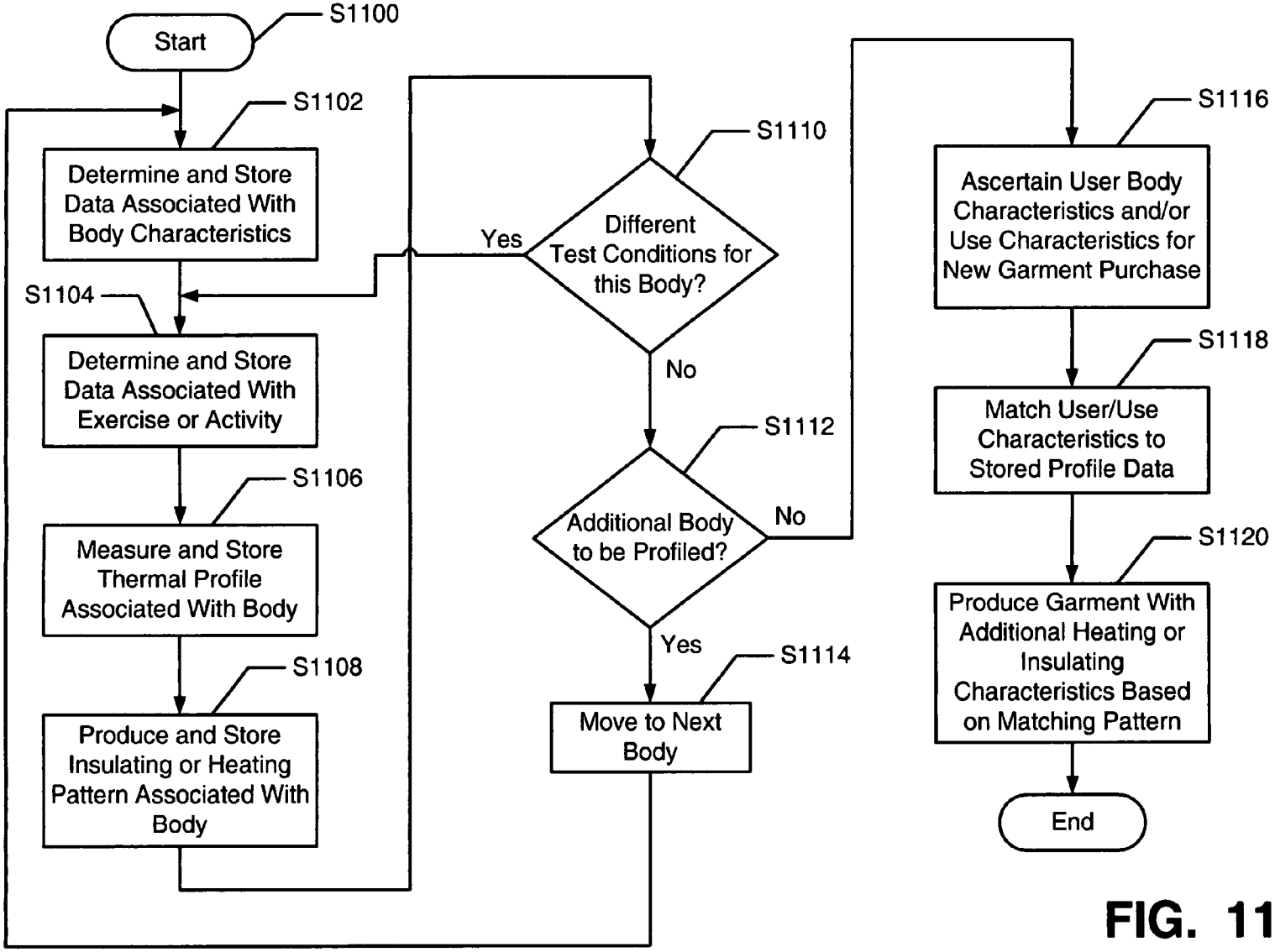
FIG. 11 includes a flow diagram illustrating example steps in a procedure for providing collections or libraries of patterns of areas of increased insulation or heat retention capability in accordance with one example of this invention.

FIG. 11 illustrates a flow diagram describing an example method for generating a collection of insulation or heat-retaining material patterns in accordance with another example aspect of this invention. As the procedure starts (S1100), a first body for thermal profiling is selected, for example, a surrogate or model from whom one or more insulation or heat-retaining material patterns for various garments will be derived and generated. Data associated with this body, e.g., relating to the body's characteristics, are determined and stored (S1102). Examples of information that may be stored relating to the body include gender, height, weight, build characteristics, age, measurements (chest, size, inseam length, waist size, etc.), and the like.

As described above in conjunction with FIG. 8, to at least some extent, athletes and/or others engaged in physical activity or athletic events may release heat at somewhat different regions of the body depending, at least in part, on the type of activity in which they are engaged and/or other characteristics associated with the activity. For example, a person may release heat somewhat differently (e.g., in different regions of the body) when involved in running or jogging as compared to when they are involved in weight lifting, rowing, or other activities. Accordingly, the person's thermal profile (and hence the most effective or optimum locations for providing additional insulation or heat-retaining materials in a garment structure) may change or differ somewhat, e.g., depending on the type of activity in which the person is involved. As another example, the environment in which the activity takes place may affect the person's thermal profile when engaged in the activity. For example, the location (e.g., indoors or outdoors), weather conditions (e.g., temperature, humidity, wind conditions, precipitation, etc.), and the like, all may affect the thermal profile generated by an individual during the activity. Accordingly, at S1104, data is collected and stored relating to the type of exercise, activity, and/or the conditions under which the exercise or activity took place. Any desired data of this type may be collected, stored, and/or correlated with a thermal profile without departing from this invention.

At S1106, the thermal profile for the body is measured and stored, correlated to the previously determined body characteristics and/or exercise or activity characteristics. The body may be involved in a specific exercise or activity before and/or during the time the thermal profile is measured. Based on the thermal profile, an insulation or heat-retaining material pattern (e.g, like those described above) may be developed (e.g., manually, automatically using a computer algorithm, etc.) at S1108. At this step, the desired pattern also may be stored and correlated with at least some of the previously determined body characteristics and/or exercise or activity characteristics.

As a next step in the procedure (S1110), a determination is made whether there is any desire to use this surrogate or model for additional thermal profiling, for example, under different test conditions (e.g., for different athletic events, different types of exercise, different exercise or activity conditions, etc.). If "Yes," the procedure returns to S1104 and data regarding the exercise or activity conditions is again stored and the procedure repeats. If "No" at S1110, the procedure then determines whether there are additional surrogates or model bodies to be profiled at this time (S1112). If "Yes," the new body for measurement is selected (S1114), the procedure returns to S1102, and data associated with the new body's characteristics are determined and/or stored. The procedure then repeats. If no additional bodies are available for profiling (answer "No" at S1112), the collection of thermal profiles and/or insulation or heat-retaining material patterns is complete (at least for the time being), and the procedure moves on to a "garment forming stage."

More specifically, in this example garment forming stage, a user seeks to obtain or purchase a new garment with insulation or heat-retaining material patterns better suited to his/her particular body type and/or the desired exercise or activity type or conditions. Accordingly, at S1116, data relating to this user's body characteristics and/or the desired exercise or activity characteristics for use of the garment is ascertained or collected. This may be accomplished at any location and/or in any manner, for example, at a retail location, over the Internet, over the telephone, through a mail-in catalogue process, etc. Based on this collected data, an insulation or heat-retaining material pattern for a garment structure that best matches the user's body characteristics and/or the anticipated use characteristics may be located from the previously stored patterns (S1118). If no exact matches for the user's body type and/or the use characteristics are found, the data representing the closest match or matches may be used. Alternatively, if desired, changes to the patterns may be derived by scaling, extrapolating, or interpolating from known profiles, patterns, and/or data points (e.g., to change the overall length, width, spacing, sizes, shapes, etc., of the material in the pattern). Once the final pattern is selected, determined, or otherwise derived, one or more garments may be produced with additional insulation or heat-retaining material provided based on the selected or derived pattern (S1120).

C. CONCLUSION

Of course, the above disclosure provides just examples of garment structures, opening patterns, insulation or heat-retaining area patterns, and/or methods that may be used in accordance with this invention. Those skilled in the art will appreciate that these descriptions merely constitute examples of this invention. The skilled artisan further will appreciate that various different garment constructions, structures, and materials may be used, and the process steps, process conditions, stored information, and the like may vary widely without departing from the invention. For example, specific process steps described above may be omitted, changed, changed in order, and the like, and additional steps may be added, etc., without departing from the invention. Also, additional steps may be included between the various process steps described above, and/or long time periods may elapse between the various described steps without departing from aspects of this invention.

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A garment including at least a torso region, comprising:

a first fabric panel; and a pattern of openings formed through the first fabric panel, wherein the pattern of openings is defined based on a thermal profile of a body, wherein the thermal profile distinguishes between areas of the body having different thermal characteristics, wherein the thermal profile defines at least a first area of the body having a first thermal characteristic and a second area of the body having a second thermal characteristic, and wherein the pattern of openings defines locations for plural openings of a first size corresponding to the first area and locations for plural openings of a second size corresponding to the second area;

further wherein the pattern of openings includes plural openings of the same size which are non-uniformly positioned in the first fabric panel.

2. A garment according to claim 1, wherein the thermal profile is determined during or after the body is engaged in a particular type of exercise, event, or activity.

3. A garment according to claim 1, wherein the thermal characteristics represent, at least in part, amounts of heat released at the different areas of the body, wherein the first area of the body releases more heat than the second area of the body, and wherein the openings of the first size are larger than the openings of the second size.

4. A garment according to claim 1, wherein the thermal profile further defines at least a third area of the body having a third thermal characteristic, and wherein the pattern of openings defines locations for plural openings of a third size corresponding to the third area.

5. A garment according to claim 1, wherein the thermal profile is obtained based on the body of a user of the garment such that the pattern of openings in the fabric panel is custom designed for the user.

6. A garment according to claim 5, wherein the thermal profile is determined during or after the body of the user is engaged in a particular type of exercise, event, or activity.

7. A garment according to claim 1, further wherein the pattern of openings includes plural openings of the first size intermingled with plural openings of the second size.

8. A garment according to claim 7, further wherein the intermingled pattern is based on the thermal profile of the body.

9. A garment according to claim 1, further comprising a pair of side vented zones, which are separate from the plural openings, wherein each of the side vented zones extends from proximate a respective arm opening to proximate a waist opening.

10. A garment, comprising:

a garment structure for at least a portion of an upper torso, wherein the garment structure includes at least a first fabric panel; and a pattern of openings formed through the first fabric panel of the garment structure, wherein the pattern of openings is defined based on a thermal profile of a body, wherein the pattern of openings includes:

plural openings of a first size or larger provided in a portion of the garment structure corresponding to at least a portion of a wearer's spine, and plural openings smaller than the first size provided in a portion of the garment structure corresponding to a first area of the wearer's back laterally located on a first side of the wearer's back from the wearer's spine;

wherein the pattern of openings includes plural openings of the same size which are non-uniformly positioned in the first fabric panel.

11. A garment according to claim 10, wherein the pattern of openings further includes additional plural openings of the first size or larger provided in a portion of the garment structure corresponding to a second area of the wearer's back laterally located from the wearer's spine and proximate to the wearer's neck.

12. A garment according to claim 10, wherein the pattern of openings further includes additional plural openings smaller than the first size provided in a portion of the garment structure corresponding to a second area of the wearer's back laterally located on a second side of the wearer's back from the wearer's spine.

13. A garment according to claim 12, wherein the pattern of openings further includes additional plural openings of the first size or larger provided in a portion of the garment structure corresponding to a third area of the wearer's back laterally located from the wearer's spine and proximate to the wearer's neck.

14. A garment according to claim 10, wherein the plural openings smaller than the first size located on the first side of the wearer's back include plural openings of a second size, wherein the second size is smaller than the first size, and plural openings of a third size or smaller, wherein the third size is smaller than the second size.

15. A garment, comprising:

a garment structure for at least a portion of an upper torso, wherein the garment structure includes at least a first fabric panel; and a pattern of openings formed through the first fabric panel of the garment structure, wherein the pattern of openings is defined based on a thermal profile of a body, wherein the pattern of openings includes:

plural openings of a first size or larger provided in a portion of the garment structure corresponding to at least a portion of a wearer's spine, plural openings smaller than the first size provided in a portion of the garment structure corresponding to a first area of the wearer's back laterally located on a first side of the wearer's back from the wearer's spine, plural openings smaller than the first size provided in a portion of the garment structure corresponding to a second area of the wearer's back laterally located on a second side of the wearer's back from the wearer's spine, plural openings of the first size or larger provided in a portion of the garment structure corresponding to a third area of the wearer's back laterally located on the first side of the wearer's back from the wearer's spine and proximate to the wearer's neck, and plural openings of the first size or larger provided in a portion of the garment structure corresponding to a fourth area of the wearer's back laterally located on the second side of the wearer's back from the wearer's spine and proximate to the wearer's neck;

further wherein the pattern of openings includes plural openings of the same size which are non-uniformly positioned in the first fabric panel.

16. A garment according to claim 15, wherein the plural openings smaller than the first size provided in the portion of the garment structure corresponding to the first area of the wearer's back includes plural openings of a second size smaller than the first size and plural openings of a third size or smaller, wherein the third size is smaller than the second size.

17. A garment according to claim 16, wherein the plural openings smaller than the first size provided in the portion of the garment structure corresponding to the second area of the wearer's back includes plural openings of the second size and plural openings of the third size or smaller.

18. A garment according to claim 10, further wherein the pattern of openings includes plural openings of the first size intermingled with plural openings of the second size.

19. A garment according to claim 18, further wherein the intermingled pattern is based on a thermal profile of the body.

20. A garment according to claim 10, further comprising a pair of side vented zones, which are separate from the plural openings, wherein each of the side vented zones extends from proximate a respective arm opening to proximate a waist opening.

21. A garment according to claim 15, further wherein the pattern of openings includes plural openings of the first size intermingled with plural openings of the second size.

22. A garment according to claim 21, further wherein the intermingled pattern is based on a thermal profile of the body.

23. A garment according to claim 15, further comprising a pair of side vented zones, which are separate from the plural openings, wherein each of the side vented zones extends from proximate a respective arm opening to proximate a waist opening.

24. A garment including at least a torso region, comprising:

a first fabric panel; and a pattern of openings formed through the first fabric panel, wherein the pattern of openings is defined based on a thermal profile of a body, wherein the thermal profile distinguishes between areas of the body having different thermal characteristics, wherein the thermal profile defines at least a first area of the body having a first thermal characteristic and a second area of the body having a second thermal characteristic, wherein the pattern of openings defines locations for plural openings of a first size corresponding to the first area and locations for plural openings of a second size corresponding to the second area;

further wherein the pattern of openings includes plural openings of the first size intermingled with plural openings of the second size.

25. A garment according to claim 24, further wherein the intermingled pattern is based on a thermal profile of the body.

* * * * *